US009599361B2

(12) United States Patent
Honda

(10) Patent No.: US 9,599,361 B2
(45) Date of Patent: Mar. 21, 2017

(54) HEAT QUANTITY DISPLAYING DEVICE AND METHOD

(71) Applicant: Azbil Corporation, Tokyo (JP)

(72) Inventor: Mitsuhiro Honda, Tokyo (JP)

(73) Assignee: AZBIL CORPORATION, Tokyo (JP)

( * ) Notice: Subject to any disclaimer, the term of this patent is extended or adjusted under 35 U.S.C. 154(b) by 326 days.

(21) Appl. No.: 14/320,806

(22) Filed: Jul. 1, 2014

(65) Prior Publication Data

US 2015/0001307 A1 Jan. 1, 2015

(30) Foreign Application Priority Data

Jul. 1, 2013 (JP) ..... 2013-137774

(51) Int. Cl.

| | |
|---|---|
| ***F24F 11/00*** | (2006.01) |
| ***F24D 19/10*** | (2006.01) |
| ***F24D 5/04*** | (2006.01) |

(52) U.S. Cl.

CPC ..... *F24F 11/0086* (2013.01); *F24D 5/04* (2013.01); *F24D 19/10* (2013.01); *F24D 19/1084* (2013.01); *F24D 2220/042* (2013.01); *F24F 2011/0091* (2013.01)

(58) Field of Classification Search

CPC ..... F24F 3/00; F24F 11/0086
USPC ..... 236/18, 94
See application file for complete search history.

(56) References Cited

U.S. PATENT DOCUMENTS

| | | | | |
|---|---|---|---|---|
| 4,819,714 | A * | 4/1989 | Otsuka | G05D 23/1904 165/217 |
| 9,176,491 | B2 * | 11/2015 | Dyess | G05B 15/02 |
| 2015/0108230 | A1 * | 4/2015 | Cloonan | F24D 19/1009 236/1 B |
| 2015/0369505 | A1 * | 12/2015 | Malve | H04W 4/008 700/276 |
| 2015/0370927 | A1 * | 12/2015 | Flaherty | F24F 11/0076 703/1 |
| 2016/0054027 | A1 * | 2/2016 | Dyess | G05B 15/02 700/277 |
| 2016/0195296 | A1 * | 7/2016 | Hoglund | F24F 11/0012 715/772 |

FOREIGN PATENT DOCUMENTS

| | | | |
|---|---|---|---|
| CN | 102901188 | A | 1/2013 |
| JP | S5929938 | A | 2/1984 |
| JP | H07-35372 | | 2/1995 |
| JP | H06-064077 | U | 9/1997 |
| KR | 10-2005-0004946 | A | 1/2005 |
| KR | 10-2005-0037258 | | 4/2005 |

* cited by examiner

*Primary Examiner* — Timothy L Maust
(74) *Attorney, Agent, or Firm* — Troutman Sanders LLP

(57) ABSTRACT

A heat quantity displaying device displays the state of supply of a heat quantity from air-conditioning equipment to a subject space that is subject to air-conditioning control. The heat quantity displaying device includes a heat quantity display that displays substantially simultaneously on a screen at least a range of heat quantities that can be supplied by the air-conditioning equipment to the subject space, and a heat quantity currently are required by the subject space.

10 Claims, 18 Drawing Sheets

FIG. 2

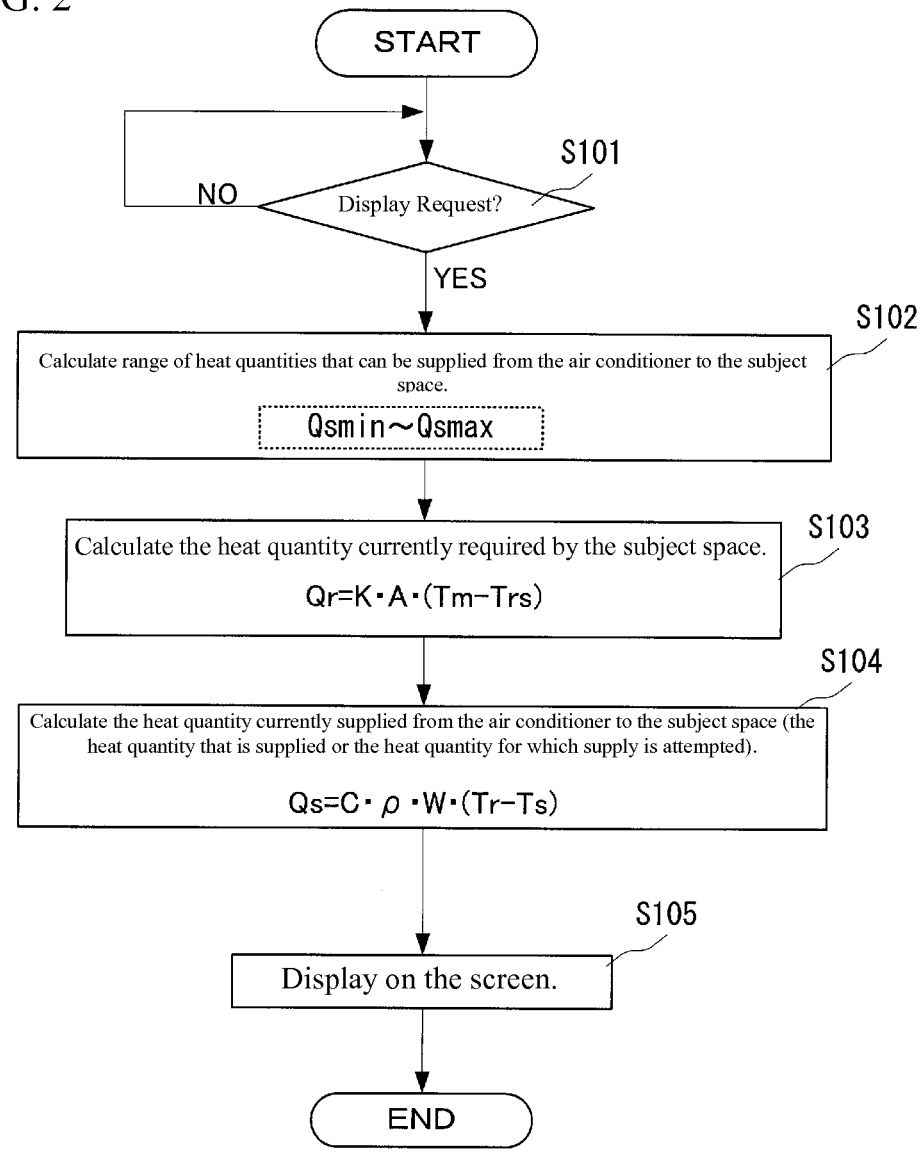

C: Specific heat of air (about 1006 J/(kg • °C))
ρ: Density of air (about 1.2 kg/m³)
W: Flow rate (m³/h) of air supplied from the air conditioner
Trs: Temperature set point (°C)
Ts: Supply air temperature (°C)
Tr: Room temperature (°C)
Tm: Average temperature of the entire surface within the subject space (°C)
A: Entire surface area of the subject space
K: Convective heat transfer coefficient of the entire surface within the subject space (Normally 9 W/ (m2 • K))

Example Display 2

HEAT QUANTITY DISPLAYING DEVICE AND METHOD

CROSS REFERENCE TO RELATED APPLICATION

This application claims priority under 35 U.S.C. §119 to Japanese Patent Application No. 2013-137774, filed on Jul. 1, 2013, the entire content of which being hereby incorporated herein by reference.

FIELD OF TECHNOLOGY

The present disclosure relates to a heat quantity displaying device that is well suited for use in an air-conditioning controlling system for, for example, a central air-conditioning system or a building multi-air-conditioning system, or the like.

BACKGROUND

Conventionally, in air-conditioning controlling systems such as for central air-conditioning systems, and the like, air conditioners have been provided as air-conditioning equipment for supplying, into a subject space that is subject to the air-conditioning control, air that has been conditioned, where the amount of cold water supplied to the air conditioner and the supply air flow rate of the conditioned air from the air conditioner have been controlled in accordance with the load conditions of the subject space that is subject to the air-conditioning control. While, in the following, a subject space that is subject to air-conditioning control shall be termed a "subject space," all instances of "subject space" within this specification shall refer to spaces that are subject to air-conditioning control.

FIG. 17 illustrates the critical portions of a conventional air-conditioning controlling system, referencing, for example, Japanese Unexamined Patent Application Publication H7-35372. In this figure, 1 is an air conditioner, 2 is a controlling device that is installed in the air conditioner 1, and 3 is a subject space that is subject to air-conditioning control, to which conditioned air (supply air) is supplied from the air conditioner 1.

A cold water coil 1A, a hot water coil 1B, and a blower (a supply air fan) 1C are provided in the air conditioner 1. Moreover, a cold water valve 4 is provided in the supply route of cold water CW to the cold water coil 1A, and a hot water valve 5 is provided in the supply path of hot water to the hot water coil 1B. A temperature sensor 6 is provided in the subject space 3 that is subject to air-conditioning control.

The controlling device 2 inputs the temperature Tr from within the subject space 3 (the room temperature), detected by the temperature sensor 6, and, if cooling, controls the opening of the cold water valve 4 or, if heating, controls the opening of the hot water valve 5 so that the room temperature Tr will match the temperature set point Trs. It also controls the speed of rotation of the supply air fan 1C. That is, it controls the temperature that of the air that is supplied from the air conditioner 1 (the supply air temperature) and the flow rate of the air supplied from the air conditioner 1 (the supply air flow rate).

In this type of air-conditioning controlling system, the room temperature Tr within the subject space 3 does not always arrive at the temperature set point Trs, notwithstanding the air conditioner providing a quantity of heat to the subject space 3 at its maximum capacity. For example, in the example illustrated in FIG. 17, in a case, as illustrated in FIG. 18, wherein the range over which the temperature of the air supplied from the air conditioner 1 can be adjusted is 15 to 30° C., the range over which the flow rate of the air that is supplied from the air conditioner 1 can be adjusted is 600 to 3000 $m^3$/h, and the temperature set point Trs is 26° C., the room temperature Tr of the subject space 3, when cooling, falls only to 27° C., for example, so does not reach the temperature set point Trs=26° C., despite the supply air temperature being 15° C. and the supply air flow rate being 3000 $m^3$/h.

While there is the suspicion that the capacity of the air conditioner 1 is inadequate, there are also the following unusual circumstances that make it difficult to conclude that the capacity of the air conditioner 1 is inadequate just because, with the air conditioner 1 at the maximum of its capacity, the room temperature Tr did not arrive at the temperature set point Trs:

(1) There are cases wherein the air-conditioning controlling method that is applied to the controlling device 2 will cause the air conditioner 1 to provide the maximum heat quantity to the subject space 3 temporarily in an attempt to cause the room temperature Tr to arrive at the temperature set point Trs. While, in such a case, the room temperature Tr does not arrive at the temperature set point Trs, this does not mean that the capacity of the air conditioner 1 is inadequate.

(2) There are cases wherein the heat quantity is not supplied to the subject space 3 at the maximum capacity of the air conditioner 1, notwithstanding the capacity of the air conditioner 1 being adequate. That is, there are cases wherein the air conditioner 1 does not demonstrate its maximum capacity, despite a thermal load exceeding the capacity of the air conditioner 1.

Such a state may occur, for example, when the air-conditioning controlling method that is applied to the controlling device 2 attempts to change the supply air temperature gradually in order to avoid causing instability in the control of the supply air temperature and the supply air flow rate.

While, over time, the negative effects of these control methods will be overcome, as time passes there will be changes in the indoor environment (in the heat production within the room, the heat that enters from the outside, and temperatures of objects within the room), making it difficult to draw conclusions.

In a method of evaluating the state of supply of the heat quantity to the subject space from the air-conditioning equipment based on whether or not the air-conditioning equipment provides the heat quantity to the subject space at its maximum capacity (whether or not the air-conditioning equipment is operating at its maximum capacity) and whether or not the room temperature of the subject space has arrived at the temperature set point (whether or not there is arrival at the temperature set point value), incorrect conclusions may be drawn if the air-conditioning controlling method that is applied to the controlling device, and the situation within the indoor environment, are not well understood.

Moreover, in an air-conditioning controlling system wherein air-conditioning is performed by dividing a large space into a plurality of zones, that is, in an air-conditioning controlling system wherein each of a plurality of zones into which the large space is divided is defined as a subject space, if the heat quantity required by a zone is not balanced with the heat quantity supplied by the air-conditioning equipment, then the heat of that zone or the air supplied from the air-conditioning equipment in that zone may have a large effect on the surrounding zones.

For example, if a large number of servers is placed in a given zone, causing that the thermal load to achieve the supply capacity of the air-conditioning equipment, then the heat from the servers will have an impact on adjacent zones as well, increasing the heat quantities required by the adjacent zones. However, it is difficult to ascertain the effects from adjacent zones when checking the statuses of each individual zone individually, making it difficult to plan countermeasures.

The present invention was created in order to solve problems such as these, and an aspect thereof is to provide a heat quantity displaying device and method wherein it is possible to evaluate appropriately the state of supply of the heat quantity from the air-conditioning equipment into the applicable air-conditioned space even without a full understanding of the air-conditioning controlling method.

Also, to provide a heat quantity displaying device and method wherein, even if the air-conditioning controlling method is not understood, the state of supply of the heat quantity from the air-conditioning equipment to each individual zone wherein a large space is divided into a plurality of zones can be evaluated appropriately, enabling cross-zone effects to be discovered easily.

SUMMARY

The present inventor has focused on the fact that "it is difficult for a building air-conditioning control administrator to evaluate appropriately whether or not the capacity of air-conditioning equipment is adequate based on whether or not the air-conditioning equipment is operating at its maximum capacity and whether or not the temperature set point value has been reached, due to an inadequate understanding of a complex air-conditioning controlling method that takes time to master." An incorrect understanding of a situation causes incorrect decisions regarding required equipment investments.

Given this, the present invention contemplates the air-conditioning administrator being able to identify problem areas in the air-conditioning system, even without understanding the air-conditioning controlling method, through a simultaneous display on a screen of at least the "range of heat quantities that can be supplied from the air-conditioning equipment to the subject space" and "the heat quantity currently required in the subject space."

While in the present disclosure, the "range of heat quantities that can be supplied to the subject space from the air-conditioning equipment" and the "heat quantity currently required by the subject space" are displayed simultaneously on the screen, preferably the "heat quantity currently supplied from the air-conditioning equipment to the subject space" is also displayed in addition to the "range of heat quantities that can be supplied to the subject space from the air-conditioning equipment" and the "heat quantity currently required by the subject space."

In the present invention, the subject space may be a single space, or it may be a subject space for each of a plurality of zones into which a large space is divided. If there are subject spaces for each of a plurality of zones, then preferably, for each zone, at least the range of heat quantities that can be applied to the zone, and the heat quantity currently required by the zone (and preferably, the heat quantity currently supplied from the air-conditioning equipment to that zone as well) are displayed simultaneously on the screen. Doing so makes it possible to evaluate simultaneously, on a single screen, the states of supply of heat quantities from the air-conditioning equipment for a plurality of zones.

When, in an air-conditioning controlling system for performing air-conditioning wherein a large space is divided into a plurality of zones, there is a mismatch between the required heat quantity and the supplied heat quantity for a given zone, this may have an effect on the heat quantity required by an adjacent zone. However, when monitoring the status of each zone independently, it is difficult to ascertain the impact from an adjacent zone. Given this, displaying, simultaneously on a single screen together with the positional relationships between the zones at least the range of heat quantities that can be applied to the zone, and the heat quantity currently required by the zone (and preferably, the heat quantity currently supplied from the air-conditioning equipment to that zone as well) makes it possible to discern the effects of adjacent zones, making it easy to discover problems between zones.

Given the present disclosure, the range of heat quantities that can be applied to the subject space from the air-conditioning equipment, and the heat quantity currently required by the subject space (and preferably, the heat quantity currently supplied from the air-conditioning equipment to the subject space as well) are displayed simultaneously on a screen, making it possible to understand these relationships on the screen with just a glance, so that even if the air-conditioning controlling method is not well understood, it is still possible to evaluate correctly the state with which the heat quantities are supplied from the air-conditioning equipment to the subject spaces within the air-conditioning control.

Moreover, in the present disclosure, each of a plurality of zones wherein a large space has been divided into zones is used as a subject space, the range of heat quantities that can be applied to the zone, and the heat quantity currently required by the zone (and preferably, the heat quantity currently supplied from the air-conditioning equipment to that zone as well) are displayed, simultaneously on a single screen together with the positional relationships between the zones, making it possible to discern the effects of adjacent zones, and making it easy to discover problems between zones.

BRIEF DESCRIPTIONS OF THE DRAWINGS

FIG. 2 is a flowchart for explaining the functions possessed by the heat quantity displaying device according to the Example.

DETAILED DESCRIPTION

The present disclosure will be explained in detail below based on the drawings.

Example

Figure 1:
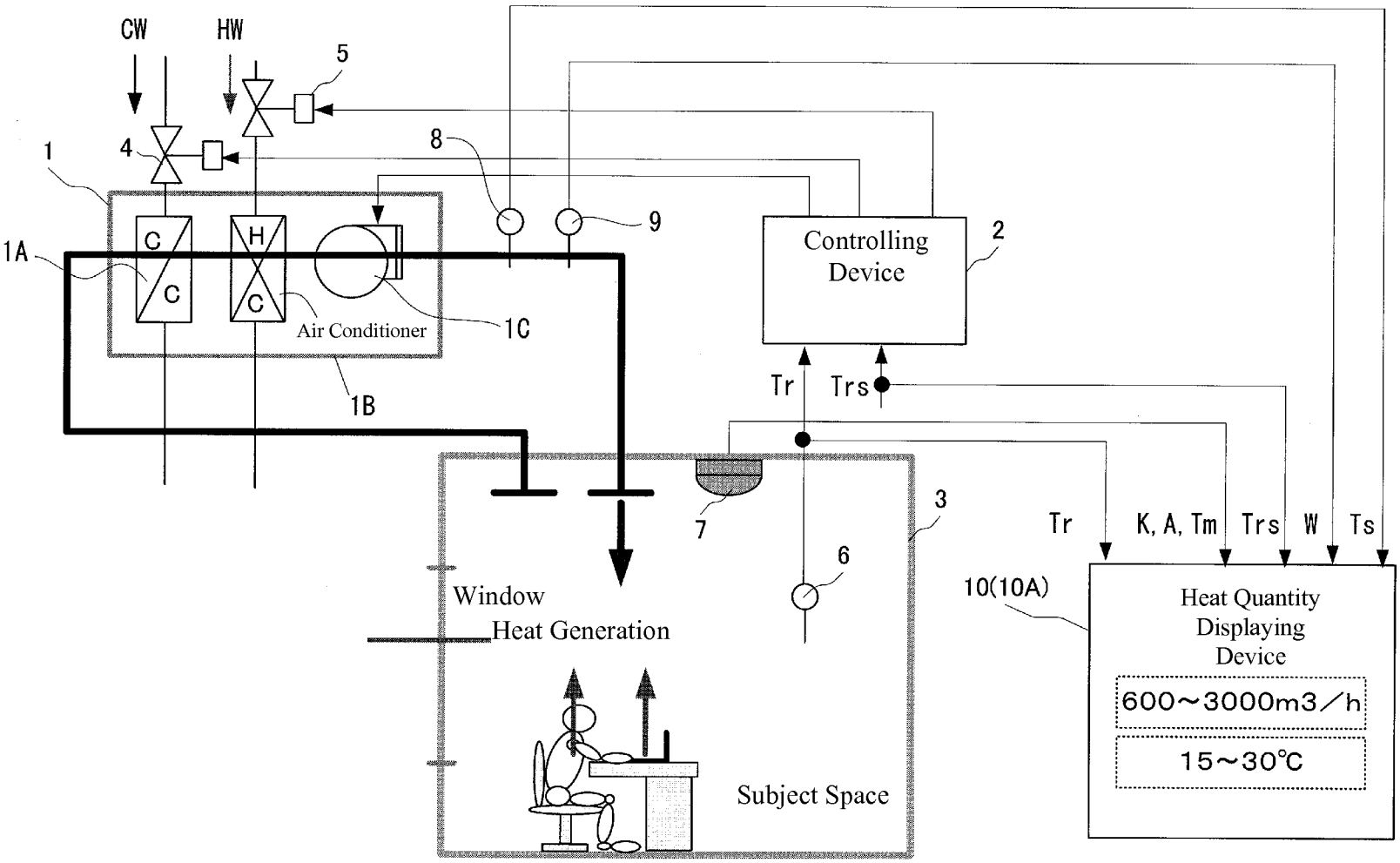
FIG. 1 is a diagram illustrating the critical components of an air-conditioning system that uses Example of a heat quantity displaying device according to the present disclosure.
Figure 17:
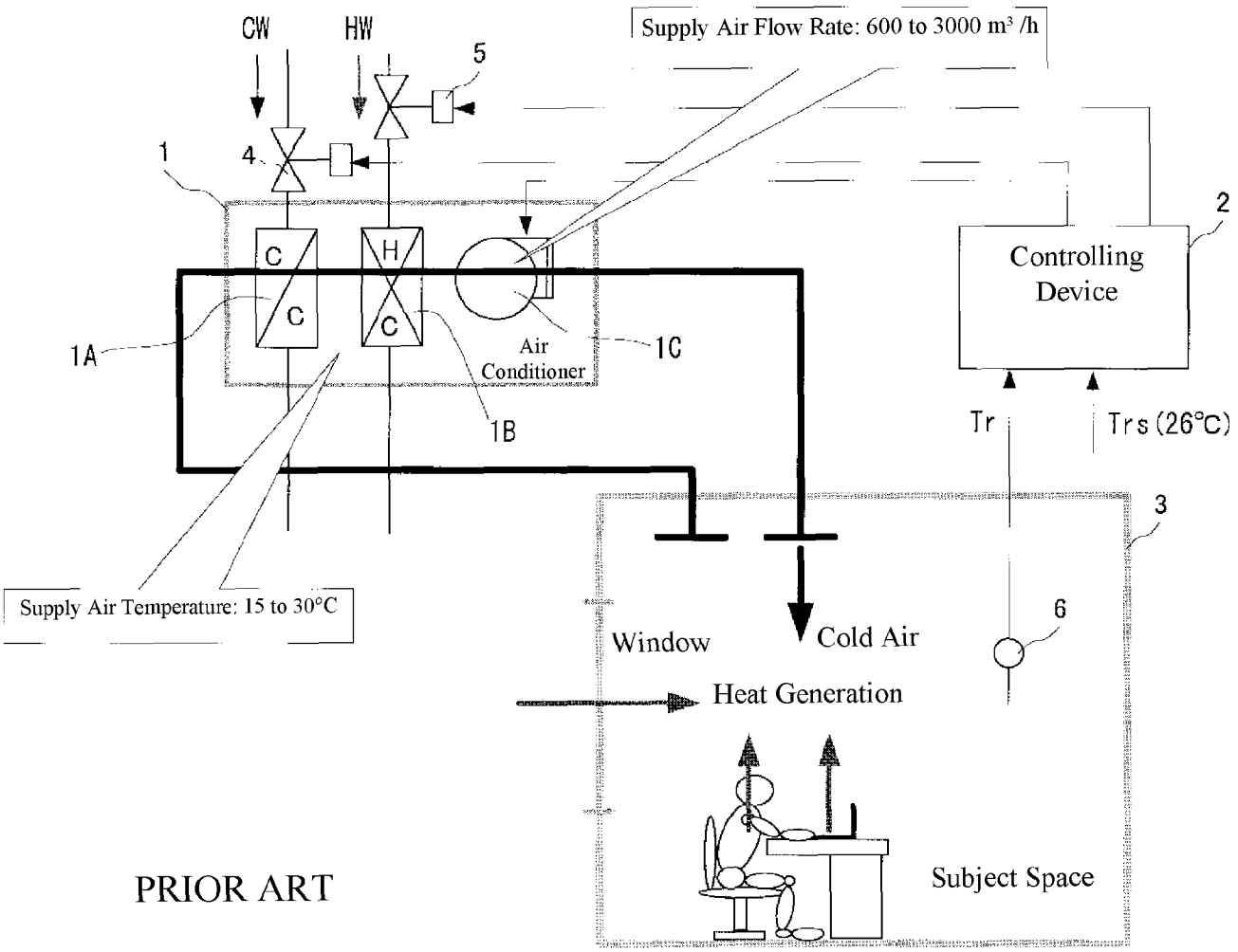
PRIOR ART FIG. 17
FIG. 17 is a diagram illustrating the critical portions of a conventional air-conditioning controlling system.
Figure 18:
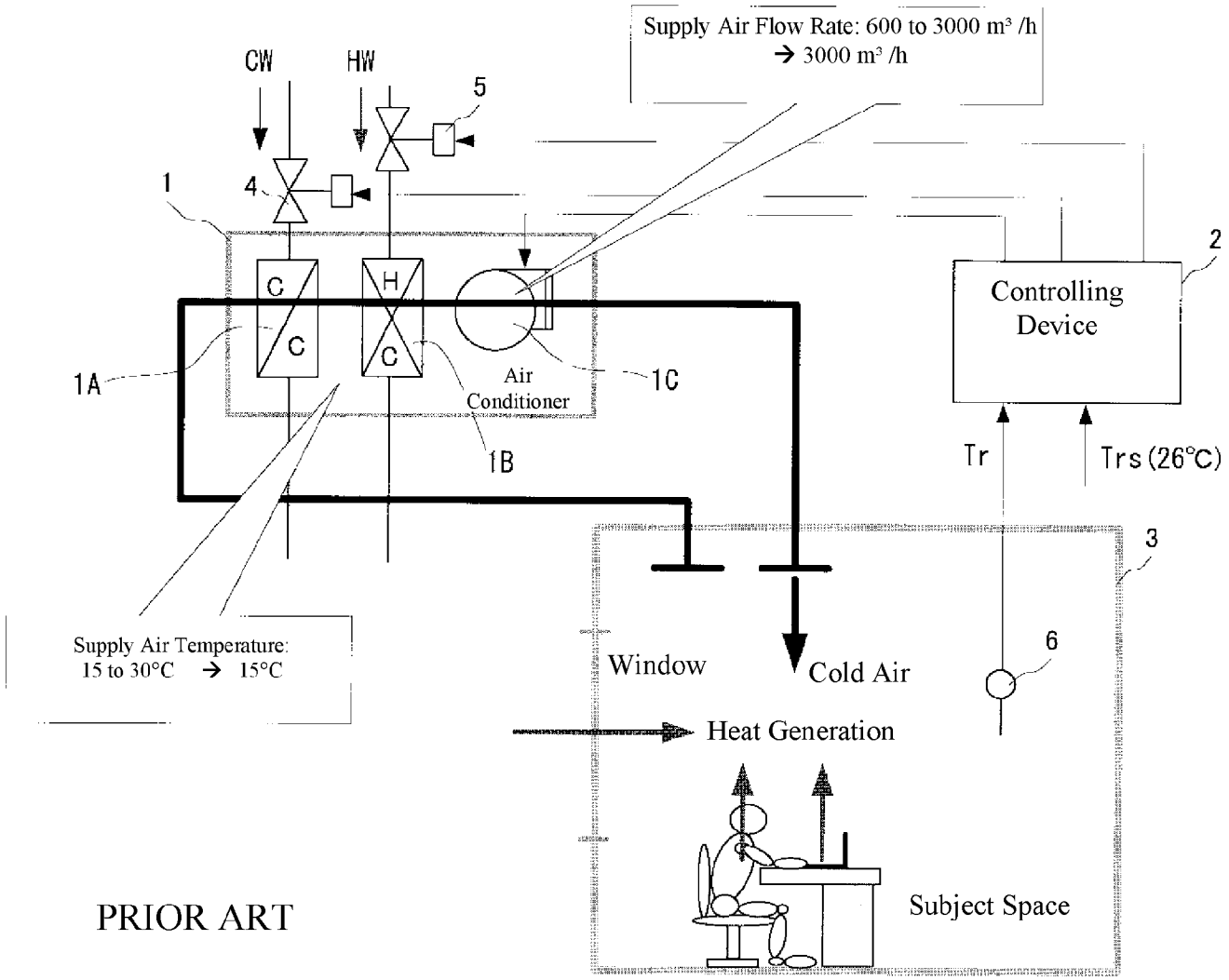
PRIOR ART FIG. 18
FIG. 18 is a diagram for explaining the problem areas in the conventional air-conditioning controlling system.

FIG. 1 is a diagram illustrating the critical components of an air-conditioning system that uses Example of a heat quantity displaying device according to the present disclosure. In this figure, codes that are the same as those in FIG. 17 indicate identical or equivalent structural elements as the structural elements explained in reference to FIG. 17, and explanations thereof are omitted.

In FIG. 1, 7 is a thermopile sensor that is provided for the subject space 3, 8 is a supply air temperature sensor for detecting the temperature Ts of the air supplied from the air conditioner 1 to the subject space 3, 9 is a supply air flow rate sensor for detecting the flow rate W of the air supplied from the air conditioner 1 to the subject space 3, and 10 (10A) is a heat quantity displaying device according to the present disclosure.

The thermopile sensor 7 sends, as information regarding the current thermal load in the subject space 3, the average temperature Tm of the entire surface within the subject space 3, the entire surface area A of the subject space 3, and the convective heat transfer coefficient K of the entire surface within the subject space 3, to the heat quantity displaying device 10A.

In the heat quantity displaying device 10A, the room temperature Tr within the subject space 3, detected by the temperature sensor 6, the temperature set point Trs, set for the room temperature Tr, the temperature Ts of the air supplied from the air conditioner 1 to the subject space 3, detected by the supply air temperature sensor 8, and the flow rate W of the air supplied by the air conditioner 1 to the subject space 3, detected by the supply air flow rate sensor 9, in addition to the information pertaining to the current thermal load within the subject space 3, from the thermopile sensor 7, are inputted into the heat quantity displaying device 10A.

Note that the range over which the temperature of the air supplied from the air conditioner 1 can be adjusted, and the range over which the flow rate of the air supplied from the air conditioner 1 can be adjusted, are set in the heat quantity displaying device 10A. In the present example, the range over which the temperature of the air that is supplied from the air conditioner 1 can be adjusted is set to 15 to 30° C., and the range over which the flow rate of the air that is supplied from the air conditioner 1 can be adjusted is set to 600 to 3000 $m^3/h$.

The heat quantity displaying device 10A is embodied through hardware, including a processor and a storage device, and a program that causes a variety of functions to be achieved in cooperation with this hardware. Specifically, a program is installed in a computer, and the invention is embodied as processing operations by the CPU following the installed program.

The functions supplied by the present example, supplied by the heat quantity displaying device 10A, will be explained below following the flowchart illustrated in FIG. 2.

When there is a display request from an air-conditioning administrator (Step S101, YES), the heat quantity displaying device 10A calculates Qsmin through Qsmax, the range of heat quantities that can be supplied from the air conditioner 1 to the subject space 3, using Equation 1, shown below (Step S102):

$$Qs=C\cdot\rho\cdot W\cdot(Tr-Ts) \quad (1).$$

In Equation (1), C is the specific heat of air (which is approximately 1006 J/(kg·° C.)), ρ is the density of air (which is approximately 1.2 $kg/m^3$), W is the flow rate ($m^3/h$) of the air supplied from the air conditioner 1, Tr is the room temperature (° C.) of the subject space 3, and Ts is the temperature (° C.) of the air that is supplied from the air conditioner 1.

In this case, the heat quantity displaying device 10A calculates the lower limit value Qsmin of the heat quantity that can be supplied from the air conditioner 1 to the subject space 3 by using, for the supply air temperature Ts, the lower limit value Tsmin (15° C.) of the range over which the temperature of the air supplied from the air conditioner 1 can be adjusted, using, as the supply air flow rate W, the lower limit value Wmin (600 $m^3/h$) of the range over which the flow rate of the air supplied from the air conditioner 1 can be adjusted, and substituting these Tsmin and Wmin, along with the room temperature Tr of the subject space 3, into the aforementioned Equation (1).

Moreover, the heat quantity displaying device 10A calculates the upper limit value Qsmax of the heat quantity that can be supplied from the air conditioner 1 to the subject space 3 by using, for the supply air temperature Ts, the upper limit value Tsmax (30° C.) of the range over which the temperature of the air supplied from the air conditioner 1 can be adjusted, using, as the supply air flow rate W, the upper limit value Wmax (3000 $m^3/h$) of the range over which the flow rate of the air supplied from the air conditioner 1 can be adjusted, and substituting these Tsmax and Wmax, along with the room temperature Tr of the subject space 3, into the aforementioned Equation (1).

Following this, the heat quantity displaying device 10A calculates the heat quantity Qr currently required by the subject space 3 using Equation (2), shown below, from information from the thermopile sensor 7 regarding the current thermal load in the subject space 3 (the average temperature Tm of the entire surface of the subject space 3, the surface area A of the entire surface of the subject space 3, and the convective heat transfer coefficient K of the entire surface of the subject space 3) and the temperature set point Trs (Step S103).

$$Qr=K\cdot A\cdot(Tm-Trs) \quad (2).$$

Moreover, the heat quantity displaying device 10A calculates the heat quantity Qs currently supplied by the air conditioner 1 to the subject space 3 using Equation (1), above, from the room temperature Tr of the subject space 3, detected by the temperature sensor 6, the temperature Ts of the air that is supplied from the air conditioner 1 to the subject space 3, detected by the supply air temperature sensor 8, and the flow rate W of the air supplied by the air conditioner 1 to the subject space 3, detected by the supply air flow rate sensor 9 (Step S104). In this case, the heat quantity Qs currently supplied by the air conditioner 1 to the subject space 3 is calculated as the quantity of heat supplied by the air conditioner 1 to the subject space 3, or that the air conditioner 1 attempts to supply to the subject space 3.

After this, the heat quantity displaying device 10A displays simultaneously, on the screen, the range Qsmin through Qsmax of the heat quantities that can be supplied from the air conditioner 1 to the subject space 3, the heat quantity Qr currently required by the subject space 3, and the heat quantity Qs currently supplied from the air conditioner 1 to the subject space 3, calculated as described above (Step S105).

Exemplary Display

Figure 3:
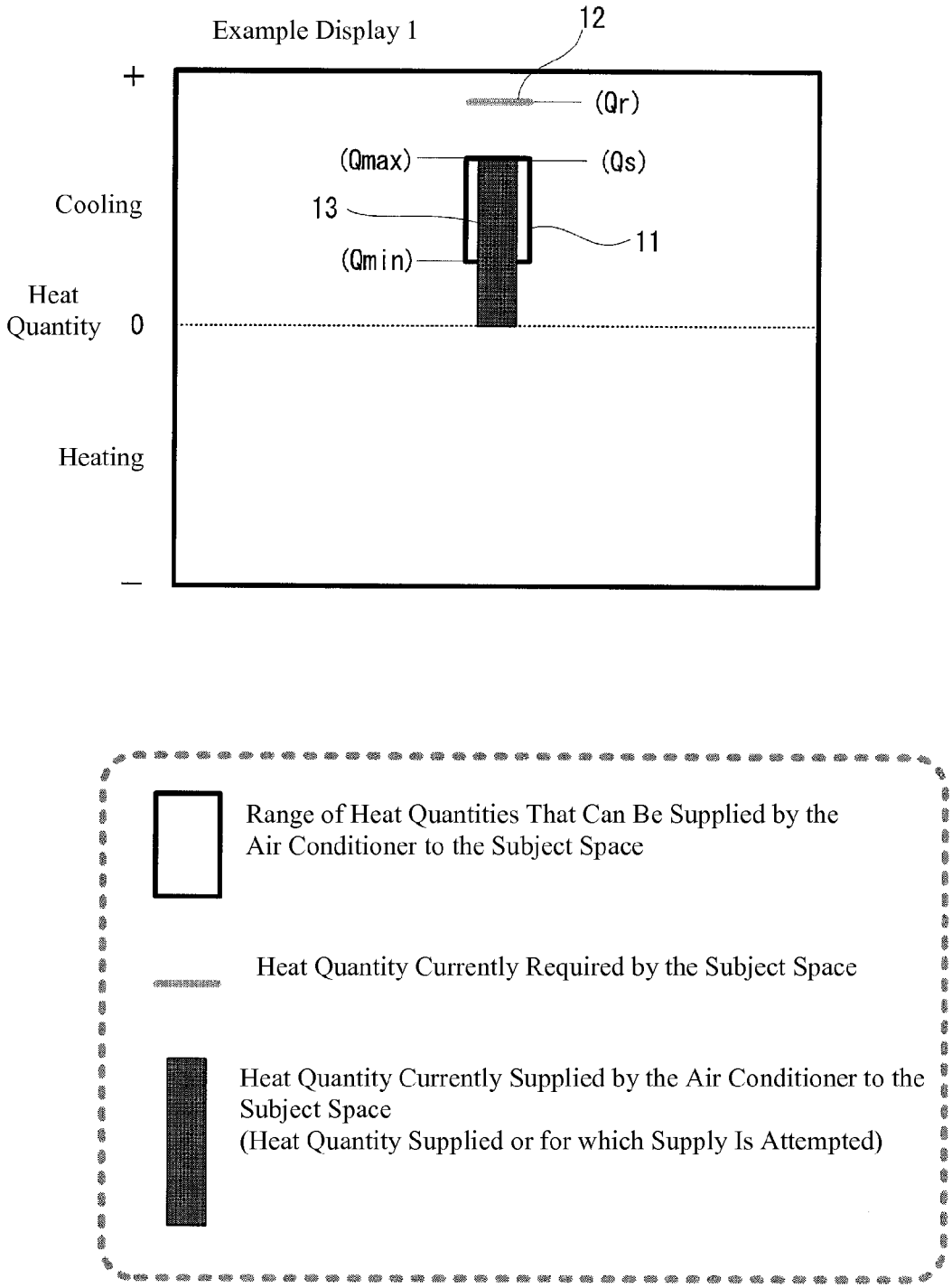
FIG. 3 is a diagram illustrating an example display on the screen of a heat quantity displaying device according to the Example.

FIG. 3 shows an example of a display (Exemplary Display) on the screen in the heat quantity displaying device 10A. In FIG. 3, the black frame 11 shows the range Qmin through Qmax of the heat quantities that can be supplied by the air conditioner 1 to the subject space 3. Moreover, the line in the horizontal direction (hereinafter termed the "horizontal line") 12 indicates the heat quantity Qr currently required by the subject space 3, and the band in the vertical direction (hereinafter termed the "vertical line") 13 indicates the heat quantity Qs currently supplied from the air conditioner 1 to the subject space 3. Note that in FIG. 3 the vertical axis indicates the heat quantity, shown centered on 0, where the positive direction indicates the quantity of heat required for cooling, and the negative direction indicates the quantity of heat required for heating.

In the Exemplary Display, the vertical line 13 extends in the positive direction, so it is understood that the subject space 3 is being cooled. Moreover, the horizontal line 12 is outside of the black frame 11 (in the positive direction), so it is understood that the heat quantity Qr currently required by the subject space 3 exceeds the upper limit value Qmax for the range of heat quantities that can be supplied from the air conditioner 1 to the subject space 3, and that the capacity of the air conditioner 1 is inadequate. Moreover, the degree to which the capacity of the air conditioner 1 is inadequate can be understood from the difference between the horizontal line 12 and the line indicating the upper limit value Qmax (hereinafter termed the "upper limit line") of the black frame 11. Moreover, because the vertical line 13 arrives at the upper limit within the black frame 11, it is understood that the heat quantity Qs currently supplied from the air conditioner 1 to the subject space 3 is at the upper limit value Qmax of the range of heat quantities that can be supplied from the air conditioner 1 to the subject space 3.

Another Exemplary Display

Figure 4:
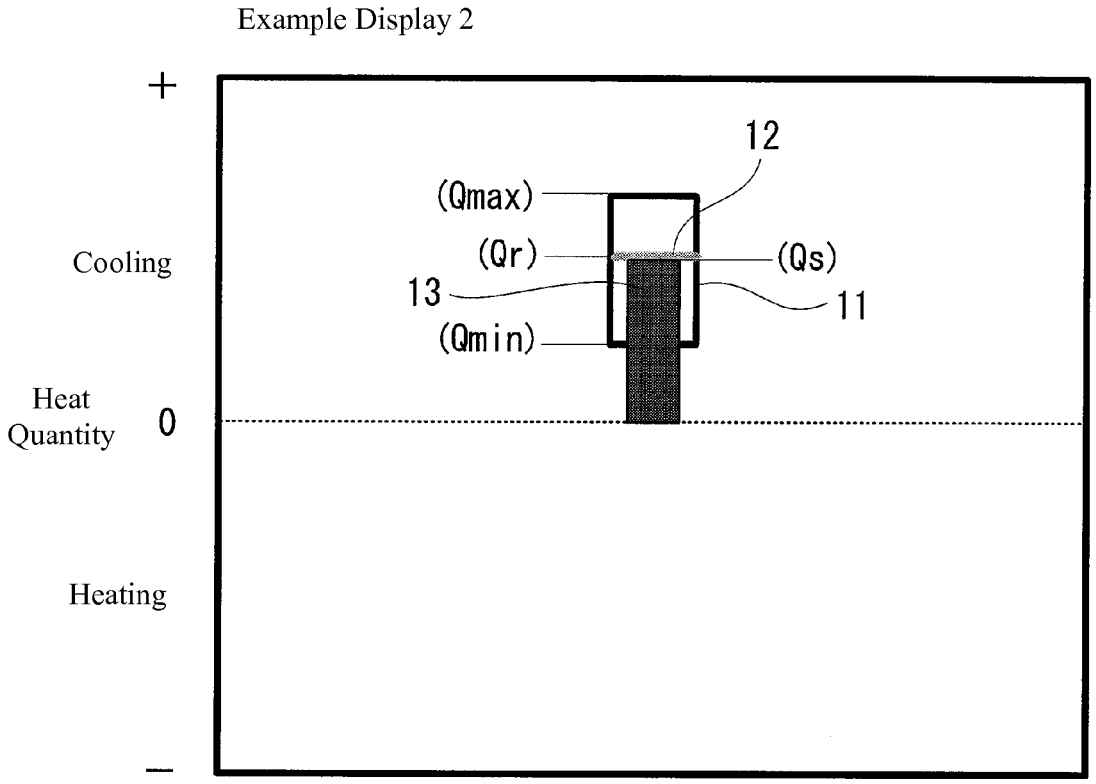
FIG. 4 is a diagram illustrating another example display on the screen of a heat quantity displaying device according to the Example.

FIG. 4 shows another example of a display on the screen in the heat quantity displaying device 10A. In Another Exemplary Display, the vertical line 13 extends in the positive direction, so it is understood that the subject space 3 is being cooled. Moreover, the horizontal line 12 is positioned within the black frame 11, so it is understood that the heat quantity Qr currently required by the subject space 3 is within the range of heat quantities that can be supplied from the air conditioner 1 to the subject space 3, and that the capacity of the air conditioner 1 is adequate. Moreover, the degree to which the capacity of the air conditioner 1 is adequate can be understood from the difference between the horizontal line 12 and the upper limit line of the black frame 11. Moreover, because the end of the vertical line 13 is coincident with the end of the horizontal line 12, it is understood that the heat quantity Qs currently supplied from the air conditioner 1 to the subject space 3 and the heat quantity Qr currently required by the subject space 3 are balanced.

Yet Another Exemplary Display

Figure 5:
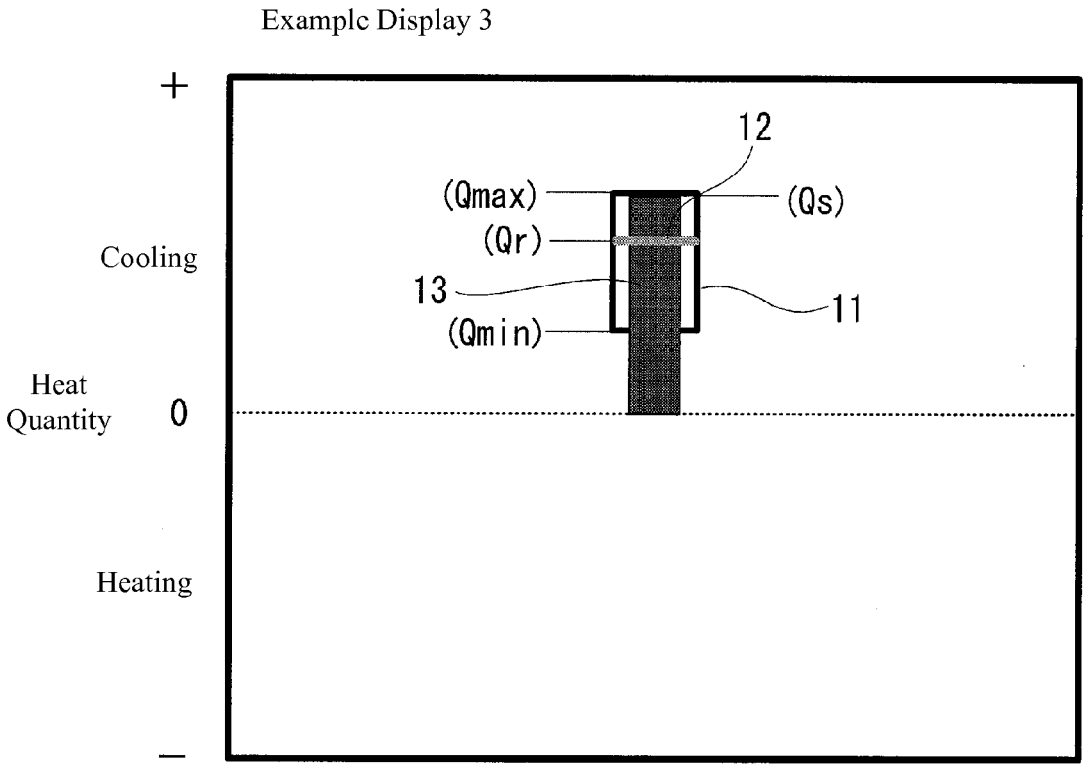
FIG. 5 is a diagram illustrating yet another example display on the screen of a heat quantity displaying device according to the Example.

FIG. 5 shows yet another example of a display on the screen in the heat quantity displaying device 10A. In Yet Another Exemplary Display, the vertical line 13 extends in the positive direction, so it is understood that the subject space 3 is being cooled. Moreover, the horizontal line 12 is positioned within the black frame 11, so it is understood that the heat quantity Qr currently required by the subject space 3 is within the range of heat quantities that can be supplied from the air conditioner 1 to the subject space 3, and that the capacity of the air conditioner 1 is adequate. Moreover, the degree to which the capacity of the air conditioner 1 is adequate can be understood from the difference between the horizontal line 12 and the upper limit line of the black frame 11. Moreover, because the vertical line 13 arrives at the upper limit within the black frame 11, it is understood that the capacity of the air conditioner 1 is adequate, but given the air conditioning controlling method that is applied to the controlling device 2, it is understood that the heat quantity Qs currently supplied by the air conditioner 1 to the subject space 3 is temporarily at the upper limit value Qmax of the range of heat quantities that can be supplied from the air conditioner 1 to the subject space 3.

Further Exemplary Display

Figure 6:
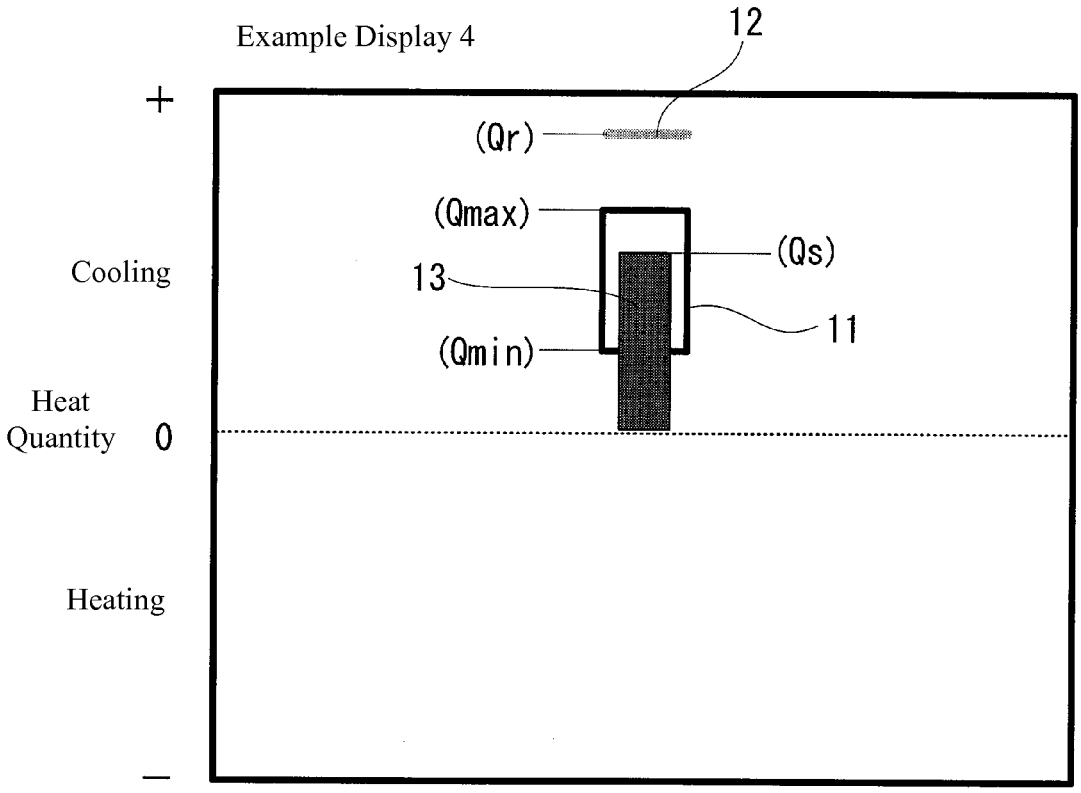
FIG. 6 is a diagram illustrating a further example display on the screen of a heat quantity displaying device according to the Example.

FIG. 6 shows a further example of a display on the screen in the heat quantity displaying device 10A. In Further Exemplary Display, the vertical line 13 extends in the positive direction, so it is understood that the subject space 3 is being cooled. Moreover, the horizontal line 12 is outside of the black frame 11 (in the positive direction), so it is understood that the heat quantity Qr currently required by the subject space 3 exceeds the upper limit value Qmax for the range of heat quantities that can be supplied from the air conditioner 1 to the subject space 3, and that the capacity of the air conditioner 1 is inadequate. Moreover, the degree to which the capacity of the air conditioner 1 is inadequate can be understood from the difference between the horizontal line 12 and the upper limit line of the black frame 11. Moreover, because the vertical line 13 is within the black frame 11, it is understood that the maximum capacity of the air conditioner 1 is not being fully utilized, given the air conditioning controlling method that is applied to the controlling device 2, despite the capacity of the air conditioner 1 being inadequate.

In this way, in the present example, the range of heat quantities Qsmin through Qsmax that can be applied to the subject space 3 from the air conditioner 1, the heat quantity Qr currently required by the subject space 3, and the heat quantity Qs currently supplied from the air conditioner 1 to the subject space 3 are displayed simultaneously on a screen, making it possible to understand these relationships on the screen with just a glance, so that even if the air-conditioning controlling method is not well understood, it is still possible to evaluate correctly the state with which the heat quantities are supplied from the air conditioner 1 to the subject space 3.

Figure 7:
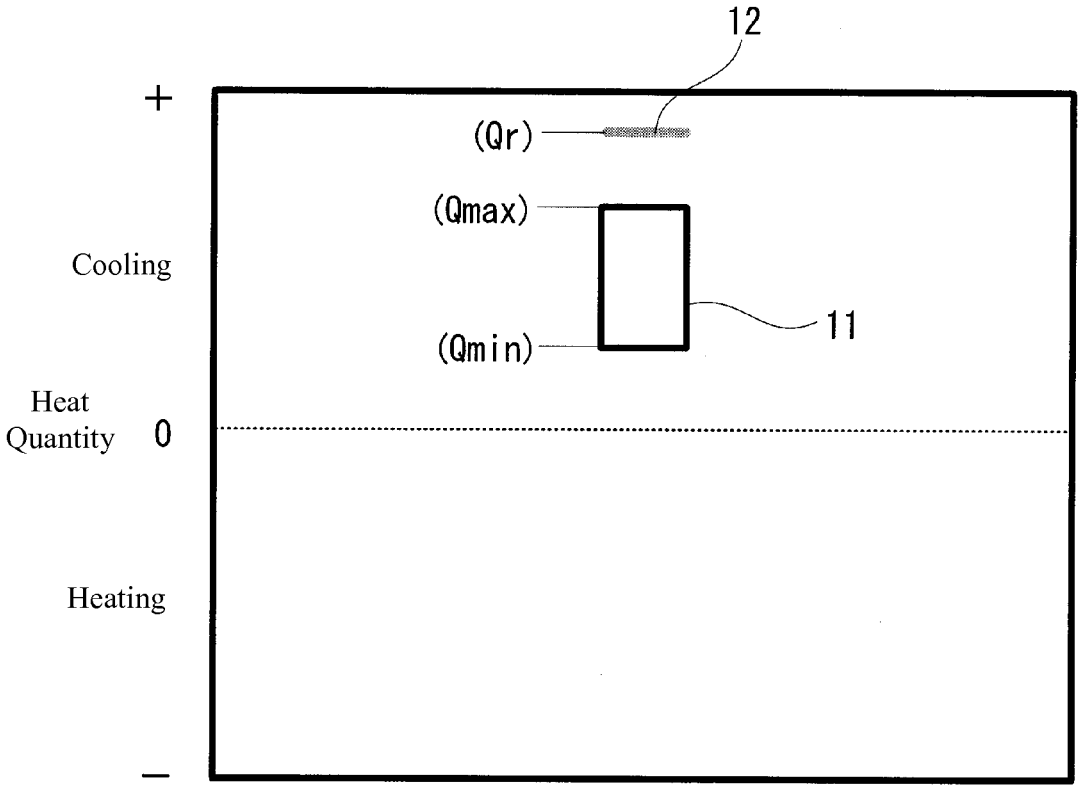
FIG. 7 is a diagram illustrating an example wherein, in a heat quantity displaying device according to the Example, only a black frame (the range of the amount of heat (heat quantities) that can be supplied into the subject space from the air-conditioning equipment) and a vertical line (the current amount of heat (a heat quantity) that is currently required by the subject space) are displayed.

Note that while in the Example the range Qsmin through Qsmax for the heat quantities that can be supplied by the air conditioner 1 to the subject space 3, the heat quantity Qr currently required by the subject space 3, and the heat quantity Qs currently supplied from the air conditioner 1 to the subject space 3 are displayed simultaneously on the same screen, instead, as illustrated in FIG. 7, for example, the display may be such that only the range Qsmin through Qsmax for the heat quantities that can be supplied by the air conditioner 1 to the subject space 3 and the heat quantity Qr currently required by the subject space 3, that is, only the frame 11 and the horizontal line 12, are displayed simultaneously on the screen, without displaying the heat quantity Qs currently supplied from the air conditioner 1 to the subject space 3.

In this way, it is possible to ascertain the degree to which the capacity of the air conditioner 1 is inadequate, or the degree to which it is adequate, by displaying only the black frame 11 and the horizontal line 12, enabling an appropriate evaluation of the state of supply of the heat quantity from the air conditioner 1 to the subject space 3.

Another Example

Figure 8:
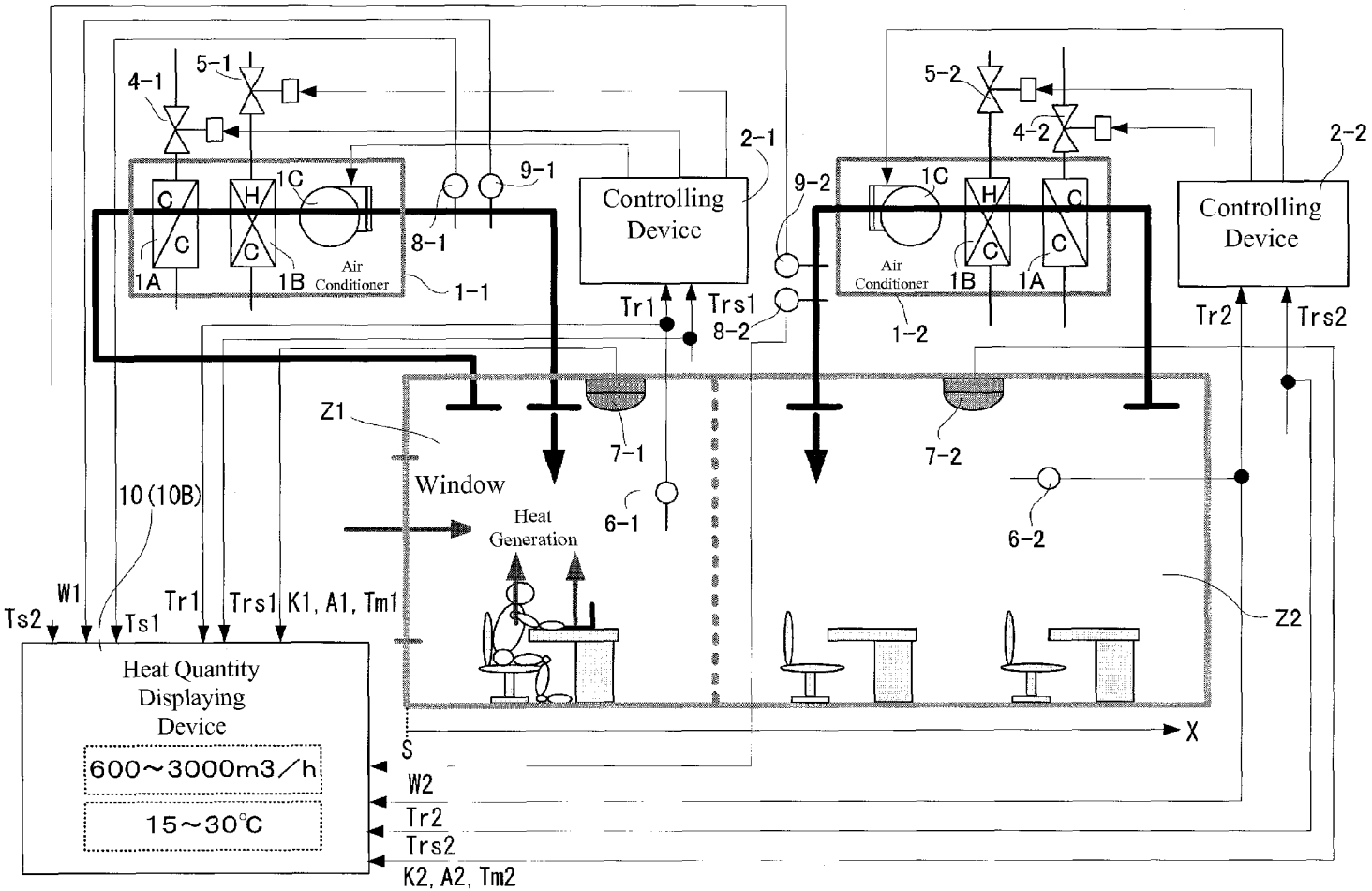
FIG. 8 is a diagram illustrating the critical components of an air-conditioning system that uses Another Example of a heat quantity displaying device according to the present disclosure.

FIG. 8 is a diagram illustrating the critical components of an air-conditioning system that uses Another Example of a heat quantity displaying device according to the present disclosure. The Another Example shows an example that is used in an air conditioning controlling system for performing air-conditioning by dividing a large space into a plurality of zones, where each of the plurality of zones into which the large space is divided serves as a subject space for the air-conditioning control. The example illustrated in FIG. 8 illustrates the most simple of such cases, wherein each of the zones Z1 and Z2 into which the large space is divided serve as subject spaces for the air-conditioning control.

In this air-conditioning controlling system, an air conditioner 1-1 and a controlling device 2-1 are provided for a zone Z1 and an air conditioner 1-2 and a controlling device 2-2 are provided for a zone Z2, where air-conditioned air from the air conditioner 1-1 is supplied to the zone Z1, and conditioned air from the air conditioner 1-2 is supplied to zone Z2.

In this air-conditioning controlling system, the controlling device 2-1 inputs the room temperature Tr1 from within the zone Z1, detected by the temperature sensor 6-1, and, if cooling, controls the opening of the cold water valve 4-1 or, if heating, controls the opening of the hot water valve 5-1 so that the room temperature Tr1 will match the temperature set point Trs1. It also controls the speed of rotation of the supply air fan 1C of the air conditioner 1-1.

The controlling device 2-2 inputs the room temperature Tr2 from within the zone Z2, detected by the temperature sensor 6-2, and, if cooling, controls the opening of the cold water valve 4-2 or, if heating, controls the opening of the hot water valve 5-2 so that the room temperature Tr2 will match the temperature set point Trs2. It also controls the speed of rotation of the supply air fan 1C of the air conditioner 1-2.

Moreover, a thermopile sensor 7-1 is provided in zone Z1, and a thermopile sensor 7-2 is provided in a zone Z2. A supply air temperature sensor 8-1 for detecting the temperature Ts1 of the air that is supplied to zone Z1 from the air conditioner 1-1, and a supply air flow rate sensor 9-1 for detecting the flow rate W1 of the air that is supplied to zone Z1 from the air conditioner 1-1 are provided for the air conditioner 1-1. A supply air temperature sensor 8-2 for detecting the temperature Ts2 of the air that is supplied to zone Z2 from the air conditioner 1-2, and a supply air flow rate sensor 9-2 for detecting the flow rate W2 of the air that is supplied to zone Z2 from the air conditioner 1-2 are provided for the air conditioner 1-2.

The thermopile sensor 7-1 sends, as information regarding the current thermal load in zone Z1, the average temperature Tm1 of the entire surface within zone Z1, the entire surface area A1 of zone Z1, and the convective heat transfer coefficient K1 of the entire surface within zone Z1, to the heat quantity displaying device 10 (10B).

The thermopile sensor 7-2 sends, as information regarding the current thermal load in zone Z2, the average temperature Tm2 of the entire surface within zone Z2, the entire surface area A2 of zone Z2, and the convective heat transfer coefficient K2 of the entire surface within zone Z2, to the heat quantity displaying device 10 (10B).

In the heat quantity displaying device 10B, the room temperatures Tr1 and Tr2 within zones Z1 and Z2, detected by the temperature sensors 6-1 and 6-2, the temperature set points Trs1 and Trs2, set for the room temperatures Tr1 and Tr2, the temperatures Ts1 and Ts2 of the air supplied from the air conditioners 1-1 and 1-2 to zones Z1 and Z2, detected by the supply air temperature sensors 8-1 and 8-2, and the flow rates W1 and W2 of the air supplied by the air conditioners 1-1 and 1-2 to zones Z1 and Z2, detected by the supply air flow rate sensors 9-1 and 9-2, in addition to the information pertaining to the current thermal loads within zones Z1 and Z2, from the thermopile sensors 7-1 and 7-2, are inputted into the heat quantity displaying device 10B.

Note that the ranges over which the temperatures of the air supplied from the air conditioners 1-1 and 1-2 can be adjusted, and the ranges over which the flow rates of the air supplied from the air conditioners 1-1 and 1-2 can be adjusted, are set in the heat quantity displaying device 10B. In the present example, the range over which the temperature of the air that is supplied from the air conditioners 1-1 and 1-2 can be adjusted is set to 15 to 30° C., and the range over which the flow rate of the air that is supplied from the air conditioners 1-1 and 1-2 can be adjusted is set to 600 to 3000 $m^3/h$.

Figure 9:
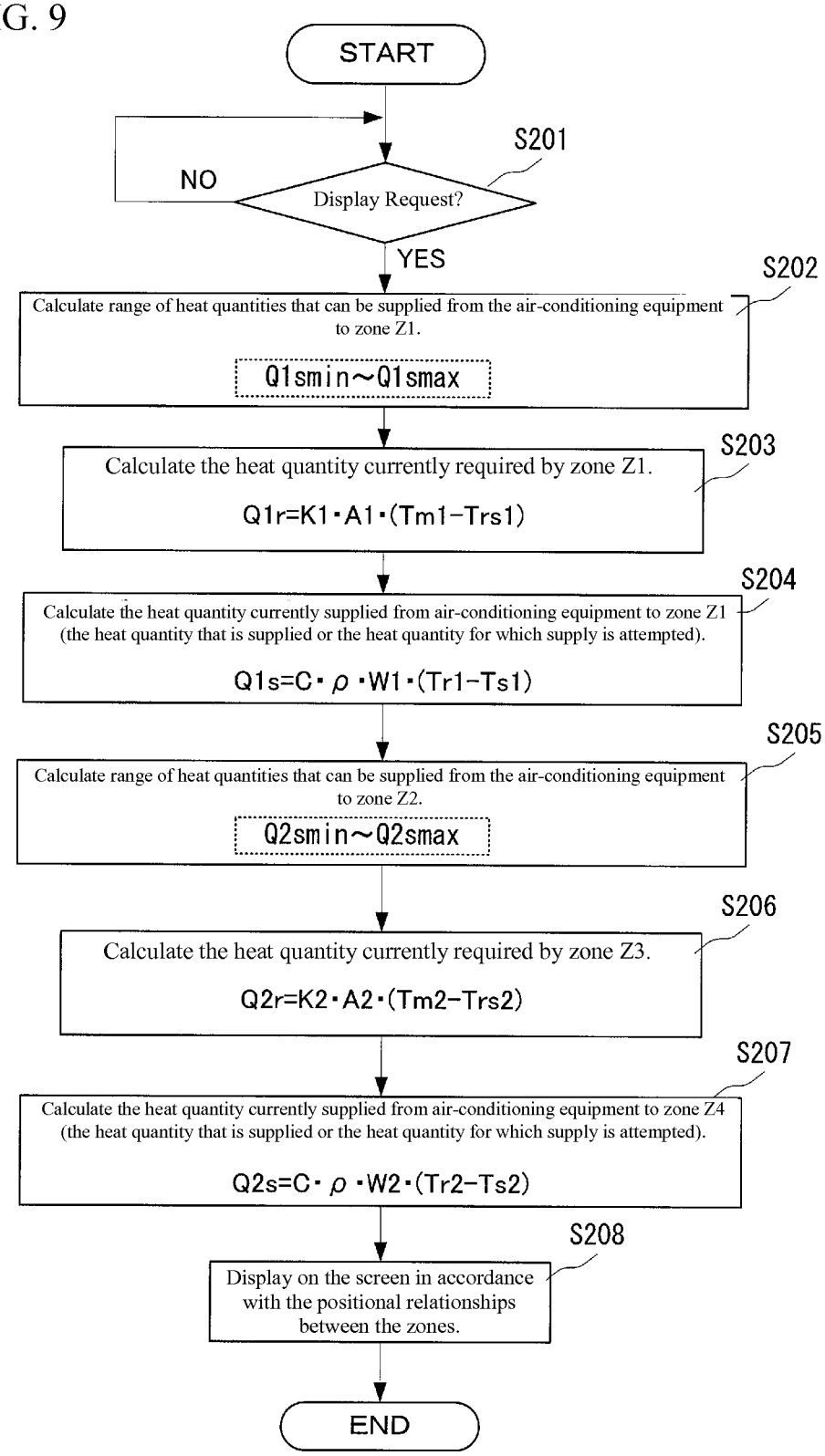
FIG. 9 is a flowchart for explaining the functions possessed by the heat quantity displaying device according to the Another Example.

The functions supplied by the present example, supplied by the heat quantity displaying device 10B, will be explained below following the flowchart illustrated in FIG. 9.

When there is a display request from an air-conditioning administrator (Step S201, YES), the heat quantity displaying device 10B calculates Q1*smin* through Q1*smax*, the range of heat quantities that can be supplied from the air conditioner 1-1 to zone Z1, using Equation 3, shown below (Step S202):

$$Q1s=C\cdot\rho\cdot W1\cdot(Tr1-Ts1) \quad (3).$$

In Equation (3), C is the specific heat of air (which is approximately 1006 J/(kg·° C.)), ρ is the density of air (which is approximately 1.2 kg/m$^3$), W1 is the flow rate (m$^3$/h) of the air supplied from the air conditioner 1-1, Tr1 is the room temperature (° C.) of zone Z1, and Ts1 is the temperature (° C.) of the air that is supplied from the air conditioner 1-1.

In this case, the heat quantity displaying device 10B calculates the lower limit value Q1*smin* of the heat quantity that can be supplied from the air conditioner 1-1 to zone Z1 by using, for the supply air temperature Ts1, the lower limit value Ts1*min* (15° C.) of the range over which the temperature of the air supplied from the air conditioner 1-1 can be adjusted, using, as the supply air flow rate W1, the lower limit value W1*min* (600 m$^3$/h) of the range over which the flow rate of the air supplied from the air conditioner 1-1 can be adjusted, and substituting these Ts1*min* and W1*min*, along with the room temperature Tr1 of zone Z1, into the aforementioned Equation (3).

Moreover, the heat quantity displaying device 10B calculates the upper limit value Q1*smax* of the heat quantity that can be supplied from the air conditioner 1-1 to zone Z1 by using, for the supply air temperature Ts1, the upper limit value Ts1*max* (30° C.) of the range over which the temperature of the air supplied from the air conditioner 1-1 can be adjusted, using, as the supply air flow rate W1, the upper limit value W1*max* (3000 m$^3$/h) of the range over which the flow rate of the air supplied from the air conditioner 1-1 can be adjusted, and substituting these Ts1*max* and W1*max*, along with the room temperature Tr1 of zone Z1, into the aforementioned Equation (3).

Following this, the heat quantity displaying device 10B calculates the heat quantity Q1*r* currently required by zone Z1 using Equation (4), shown below, from information from the thermopile sensor 7-1 regarding the current thermal load in zone Z1 (the average temperature Tm1 of the entire surface of zone Z1, the surface area A1 of the entire surface of zone Z1, and the convective heat transfer coefficient K1 of the entire surface of zone Z1) and from the temperature set point Trs1 (Step S203).

$$Q1r=K1\cdot A1\cdot(Tm1-Trs1) \quad (4)$$

Moreover, the heat quantity displaying device 10B calculates the heat quantity Q1*s* currently supplied by the air conditioner 1-1 to zone Z1 using Equation (3), above, from the room temperature Tr1 of zone Z1, detected by the temperature sensor 6-1, the temperature Ts1 of the air that is supplied from the air conditioner 1-1 to zone Z1, detected by the supply air temperature sensor 8-1, and the flow rate W1 of the air supplied by the air conditioner 1-1 to zone Z1, detected by the supply air flow rate sensor 9-1 (Step S204). In this case, the heat quantity Q1*s* currently supplied by the air conditioner 1-1 to zone Z1 is calculated as the quantity of heat supplied by the air conditioner 1-1 to zone Z1, or that the air conditioner 1-1 attempts to supply to zone Z1.

Following this, the heat quantity displaying device 10B uses the following Equation (5) to calculate the range Q2*smin* through Q2*smax* of the heat quantities that can be supplied from the air conditioner 1-2 to the zone Z2 (Step S205):

$$Q2s=C\cdot\rho\cdot W2\cdot(Tr2-Ts2) \quad (5).$$

In Equation (5), C is the specific heat of air (which is approximately 1006 J/(kg·° C.)), ρ is the density of air (which is approximately 1.2 kg/m$^3$), W2 is the flow rate (m$^3$/h) of the air supplied from the air conditioner 1-2, Tr2 is the room temperature (° C.) of zone Z2, and Ts2 is the temperature (° C.) of the air that is supplied from the air conditioner 1-2.

In this case, the heat quantity displaying device 10B calculates the lower limit value Q2*smin* of the heat quantity that can be supplied from the air conditioner 1-2 to zone Z2 by using, for the supply air temperature Ts2, the lower limit value Ts2*min* (15° C.) of the range over which the temperature of the air supplied from the air conditioner 1-2 can be adjusted, using, as the supply air flow rate W2, the lower limit value W2*min* (600 m$^3$/h) of the range over which the flow rate of the air supplied from the air conditioner 1-2 can be adjusted, and substituting these Ts2*min* and W2*min*, along with the room temperature Tr2 of zone Z2, into the aforementioned Equation (5).

Moreover, the heat quantity displaying device 10B calculates the upper limit value Q2*smax* of the heat quantity that can be supplied from the air conditioner 1-2 to zone Z2 by using, for the supply air temperature Ts2, the upper limit value Ts2*max* (30° C.) of the range over which the temperature of the air supplied from the air conditioner 1-2 can be adjusted, using, as the supply air flow rate W2, the upper limit value W2*max* (3000 m$^3$/h) of the range over which the flow rate of the air supplied from the air conditioner 1-2 can be adjusted, and substituting these Ts2*max* and W2*max*, along with the room temperature Tr2 of zone Z2, into the aforementioned Equation (5).

Following this, the heat quantity displaying device 10B calculates the heat quantity Q2*r* currently required by zone Z2 using Equation (6), shown below, from information from the thermopile sensor 7-2 regarding the current thermal load in zone Z2 (the average temperature Tm2 of the entire surface of zone Z2, the surface area A2 of the entire surface of zone Z2, and the convective heat transfer coefficient K2 of the entire surface of zone Z2) and from the temperature set point Trs2 (Step S206).

$$Q2r=K2\cdot A2\cdot(Tm2-Trs2) \quad (6).$$

Moreover, the heat quantity displaying device 10B calculates the heat quantity Q2*s* currently supplied by the air conditioner 1-2 to zone Z2 using Equation (5), above, from the room temperature Tr2 of zone Z2, detected by the temperature sensor 6-2, the temperature Ts2 of the air that is supplied from the air conditioner 1-2 to zone Z2, detected by the supply air temperature sensor 8-2, and the flow rate W2 of the air supplied by the air conditioner 1-2 to zone Z2, detected by the supply air flow rate sensor 9-2 (Step S207). In this case, the heat quantity Q2*s* currently supplied by the air conditioner 1-2 to zone Z2 is calculated as the quantity of heat supplied by the air conditioner 1-2 to zone Z2, or that the air conditioner 1-2 attempts to supply to zone Z2.

After this, the heat quantity displaying device 10B displays simultaneously, on the screen, the ranges Q1*smin* through Q1*smax* and Q2*smin* through Q2*smax* of the heat quantities that can be supplied from the air conditioners 1-1 and 1-2 to zones Z1 and Z2, the heat quantities Q1*r* and Q2*r* currently required by zones Z1 and Z2, and the heat quantities Q1*s* and Q2*s* currently supplied from the air conditioners 1-1 and 1-2 to zones Z1 and Z2, calculated as described above, for each zone Z1 and Z2, together with the positional relationships between the zones Z1 and Z2 (Step S208).

Exemplary Display

Figure 10:
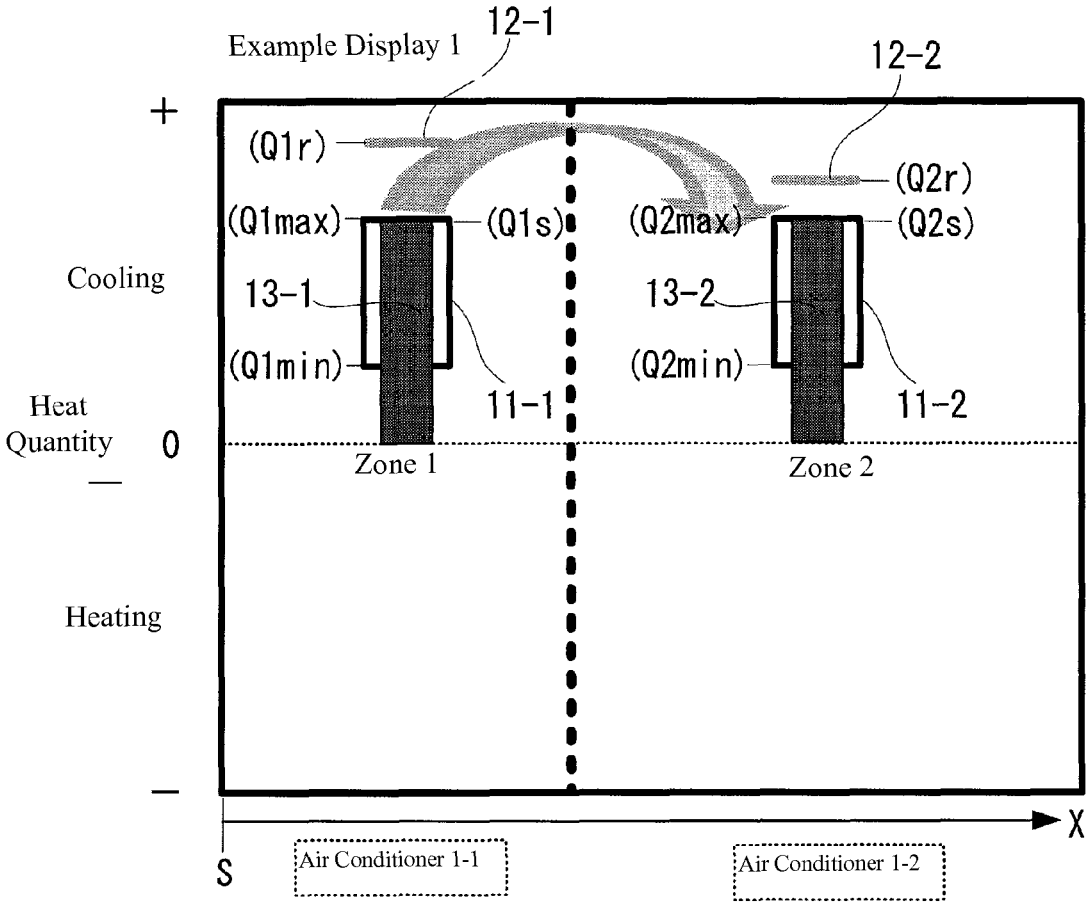
FIG. 10 is a diagram illustrating an example display on the screen of a heat quantity displaying device according to the Another Example.

FIG. 10 shows an example of a display (Exemplary Display) on the screen in the heat quantity displaying device 10B. In FIG. 10, the black frame 11-1 shows the range Q1*min* through Q1*max* of the heat quantities that can be supplied by the air conditioner 1-1 to zone Z1, the horizontal line 12-1 indicates the heat quantity Q1*r* currently required by zone Z1, and the vertical line 13-1 indicates the heat quantity Q1*s* currently supplied from the air conditioner 1-1 to zone Z1. Moreover, the black frame 11-2 shows the range Q2*min* through Q2*max* of the heat quantities that can be supplied by the air conditioner 1-2 to zone Z2, the horizontal line 12-2 indicates the heat quantity Q2*r* currently required by zone Z2, and the vertical line 13-2 indicates the heat quantity Q2*s* currently supplied from the air conditioner 1-2 to zone Z2.

Note that in the figure the vertical axis indicates the heat quantity, shown centered on 0, where the positive direction indicates the quantity of heat required for cooling, and the negative direction indicates the quantity of heat required for heating. Moreover, the horizontal axis indicates the distance X from the position S on the window side of zone Z1. This distance X indicates the positional relationship between zones Z1 and Z2, so it is understood that zones Z1 and Z2 are adjacent to each other.

In the Exemplary Display, the vertical line 13-1 extends in the positive direction, so it is understood that zone Z1 is being cooled. Moreover, the horizontal line 12-1 is outside of the black frame 11-1 (in the positive direction), so it is understood that the heat quantity Q1*r* currently required by zone Z1 exceeds the upper limit value Q1*max* for the range of heat quantities that can be supplied from the air conditioner 1-1 to zone Z1, and that the capacity of the air conditioner 1-1 is inadequate. Moreover, the degree to which the capacity of the air conditioner 1-1 is inadequate can be understood from the difference between the horizontal line 12-1 and the upper limit line of the black frame 11-1. Moreover, because the vertical line 13-1 arrives at the upper limit within the black frame 11-1, it is understood that the heat quantity Q1*s* currently supplied from the air conditioner 1-1 to zone Z1 is at the upper limit value Q1*max* of the range of heat quantities that can be supplied from the air conditioner 1-1 to zone Z1.

Moreover, in the Exemplary Display, the vertical line 13-2 extends in the positive direction, so it is understood that zone Z2 is being cooled. Moreover, the horizontal line 12-2 is outside of the black frame 11-2 (in the positive direction), so it is understood that the heat quantity Q2*r* currently required by zone Z2 exceeds the upper limit value Q2*max* for the range of heat quantities that can be supplied from the air conditioner 1-2 to zone Z2, and that the capacity of the air conditioner 1-2 is inadequate. Moreover, the degree to which the capacity of the air conditioner 1-2 is inadequate can be understood from the difference between the horizontal line 12-2 and the upper limit line of the black frame 11-2. Moreover, because the vertical line 13-2 arrives at the upper limit within the black frame 11-2, it is understood that the heat quantity Q2*s* currently supplied from the air conditioner 1-2 to zone Z2 is at the upper limit value Q2*max* of the range of heat quantities that can be supplied from the air conditioner 1-2 to zone Z2.

Furthermore, in this Exemplary Display, the difference between the heat quantity Q1*r* currently required by zone Z1 and the heat quantity Q1*max* that can be supplied by the air conditioner 1-1 to zone Z1 is large, so it is understood that the heat produced (the thermal load) in zone Z1 may have an effect on zone Z2, and may have an effect on the heat quantity Q2*r* currently required by zone Z2.

Another Exemplary Display

Figure 11:
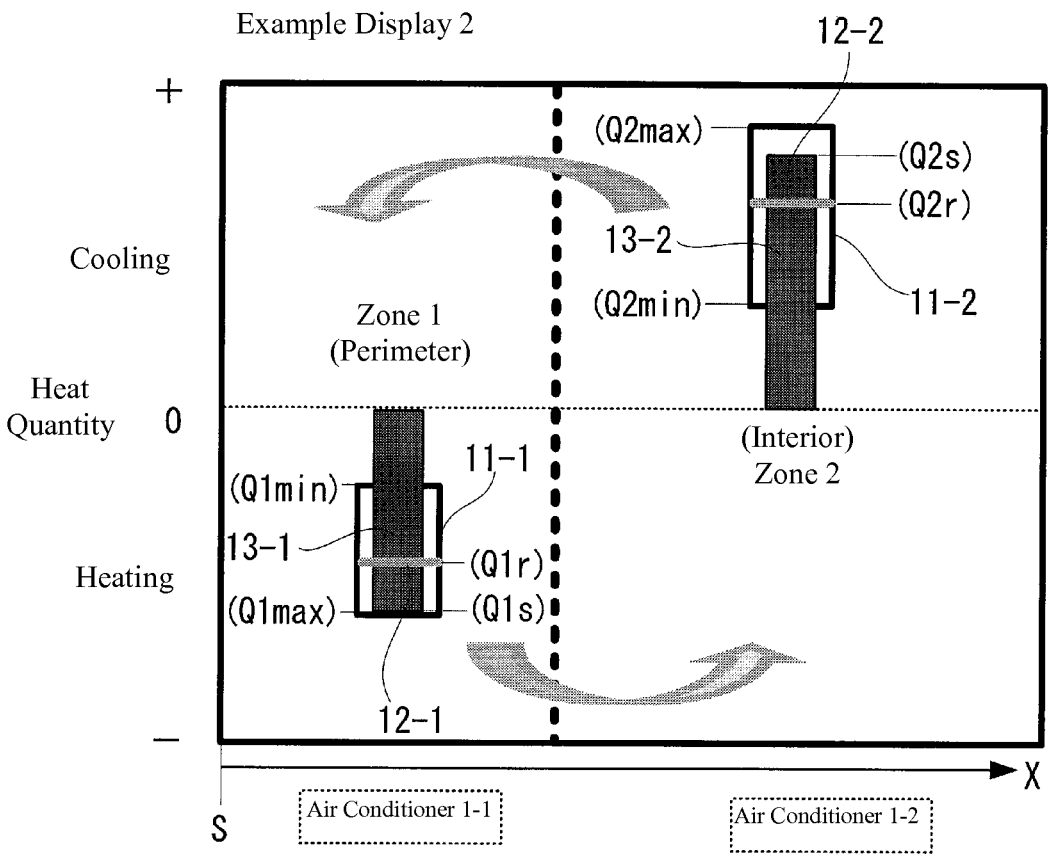
FIG. 11 is a diagram illustrating another example display on the screen of a heat quantity displaying device according to the Another Example.

FIG. 11 shows another example of a display on the screen in the heat quantity displaying device 10B. In Another Exemplary Display, the vertical line 13-1 extends in the negative direction, so it is understood that zone Z1 is being heated. Moreover, the horizontal line 12-1 is positioned within the black frame 11-1, so it is understood that the heat quantity Q1*r* currently required by zone Z1 is within the range of heat quantities that can be supplied from the air conditioner 1-1 to zone Z1, and that the capacity of the air conditioner 1-1 is adequate. Moreover, the degree to which the capacity of the air conditioner 1-1 is adequate can be understood from the difference between the horizontal line 12-1 and the upper limit line of the black frame 11-1. Moreover, because the vertical line 13-1 exceeds the horizontal line 12-1, it is understood that a heat quantity exceeding the heat quantity that is required by zone Z1 is being supplied. Moreover, because the vertical line 13-1 arrives at the upper limit within the black frame 11-1, it is understood that the heat quantity Q1*s* currently supplied from the air conditioner 1-1 to zone Z1 is at the upper limit value Q1*max* of the range of heat quantities that can be supplied from the air conditioner 1-1 to zone Z1.

Moreover, in the Another Exemplary Display, the vertical line 13-2 extends in the positive direction, so it is understood that zone Z2 is being cooled. Moreover, the horizontal line 12-2 is positioned within the black frame 11-2, so it is understood that the heat quantity Qr2 currently required by zone Z2 is within the range of heat quantities that can be supplied from the air conditioner 1-2 to zone Z2, and that the capacity of the air conditioner 1-2 is adequate. Moreover, the degree to which the capacity of the air conditioner 1-2 is adequate can be understood from the difference between the horizontal line 12-2 and the upper limit line of the black frame 11-2. Moreover, because the vertical line 13-2 exceeds the horizontal line 12-2, it is understood that a heat quantity exceeding the heat quantity that is required by zone Z2 is being supplied. Moreover, because the vertical line 13-2 does not arrive at the upper limit within the black frame 11-2, it is understood that the heat quantity Q2*s* currently supplied from the air conditioner 1-2 to zone Z2 has excess capacity in relation to the upper limit value Q2*max* of the range of heat quantities that can be supplied from the air conditioner 1-2 to zone Z2.

In the wintertime, there may be cases wherein, as seen in this example, heating is required on the window side (at the perimeter), and cooling is required on the inside (in the interior). In such a case, a heat quantity supply state in a form such as in the Another Exemplary Display will be displayed on the screen, and it is possible to ascertain, with just a glance, that heating is being performed in zone Z1 (at the perimeter) and cooling is being performed in zone Z2 (in the interior), and that greater heat quantities than the required heat quantities are being provided in both zone Z1 and zone Z2, by looking at the content of the Another Exemplary Display.

Here it is quite likely that there is the phenomenon known as indoor mixing loss, where heating air that is supplied to zone Z1 cancels out cooling air that is supplied to zone Z2. Conventionally, when such indoor mixing loss has occurred it has often been overlooked. In the Another Exemplary Display, the statuses with which heat quantities are supplied from the air conditioners 1-1 and 1-2 to zones Z1 and Z2 are displayed, together with the positional relationships between zones Z1 and Z2, making it possible to recognize the indoor mixing loss situation at a glance. When this phenomenon is recognized, countermeasures can be performed such as reducing the amount of air supplied, while observing the state of comfort within the MOM.

Yet Another Exemplary Display

Figure 12:
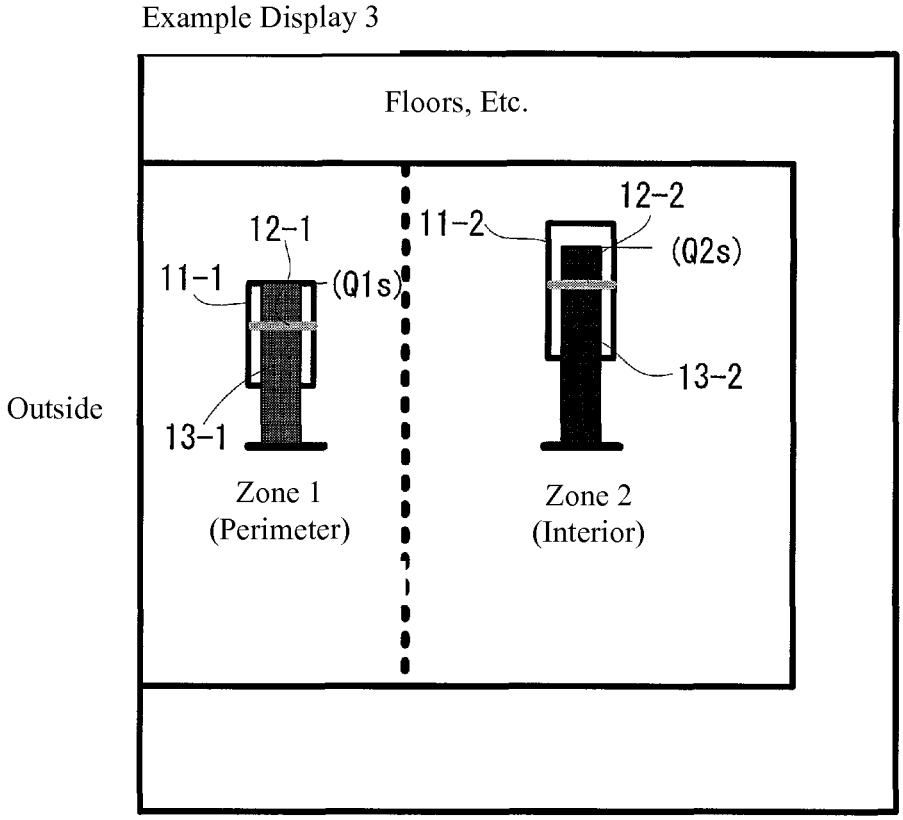
FIG. 12 is a diagram illustrating yet another example display on the screen of a heat quantity displaying device according to Another Example.

FIG. 12 shows yet another example of a display on the screen in the heat quantity displaying device 10B. Yet Another Exemplary Display shows, in a building floor plan, the state of supply of heat quantities in the same zones Z1 and Z2 as in the Another Exemplary Display. In this case, the vertical line 13-1 that indicates the heat quantity Q1*s* currently supplied by the air conditioner 1-1 to zone Z1 is, for example, shown in red in order to show that the heat quantity is required for heating. The vertical line 13-2 that indicates the heat quantity Q2*s* currently supplied by the air conditioner 1-2 to zone Z2 is, for example, shown in blue in order to show that the heat quantity is required for cooling.

Figure 13:
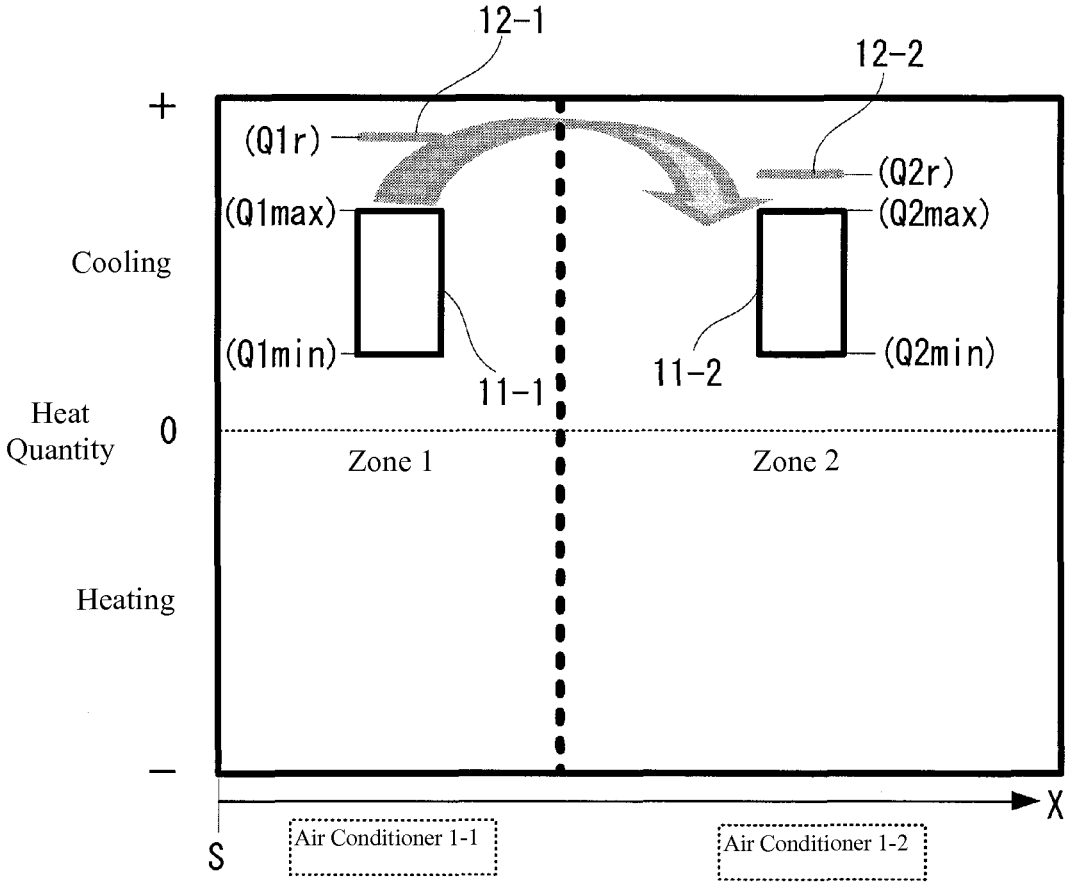
FIG. 13 is a diagram illustrating an example wherein, in a heat quantity displaying device according to the Another Example, only a black frame (the range of the amount of heat (heat quantities) that can be supplied into a zone from the air-conditioning equipment) and a vertical line (the current amount of heat (a heat quantity) that is currently required by the zone) are displayed.

Note that in the Another Example as well, as with the Example, the heat quantities Q1*s* and Q2*s* currently supplied from the air conditioners 1-1 and 1-2 to zones Z1 and Z2 are not displayed, but rather, as illustrated in FIG. 13, for example, only the ranges Q1*s* min through Q1*smax* and Q2*smin* through Q2*smax* of the heat quantities that can be supplied from the air conditioners 1-1 and 1-2 to zones Z1 and Z2 and the heat quantities Q1*r* and Q2*r* currently required by zones Z1 and Z2, that is, only the black frames 11-1 and 11-2, and horizontal lines 12-1 and 12-2, are displayed simultaneously on the screen.

Figure 14:
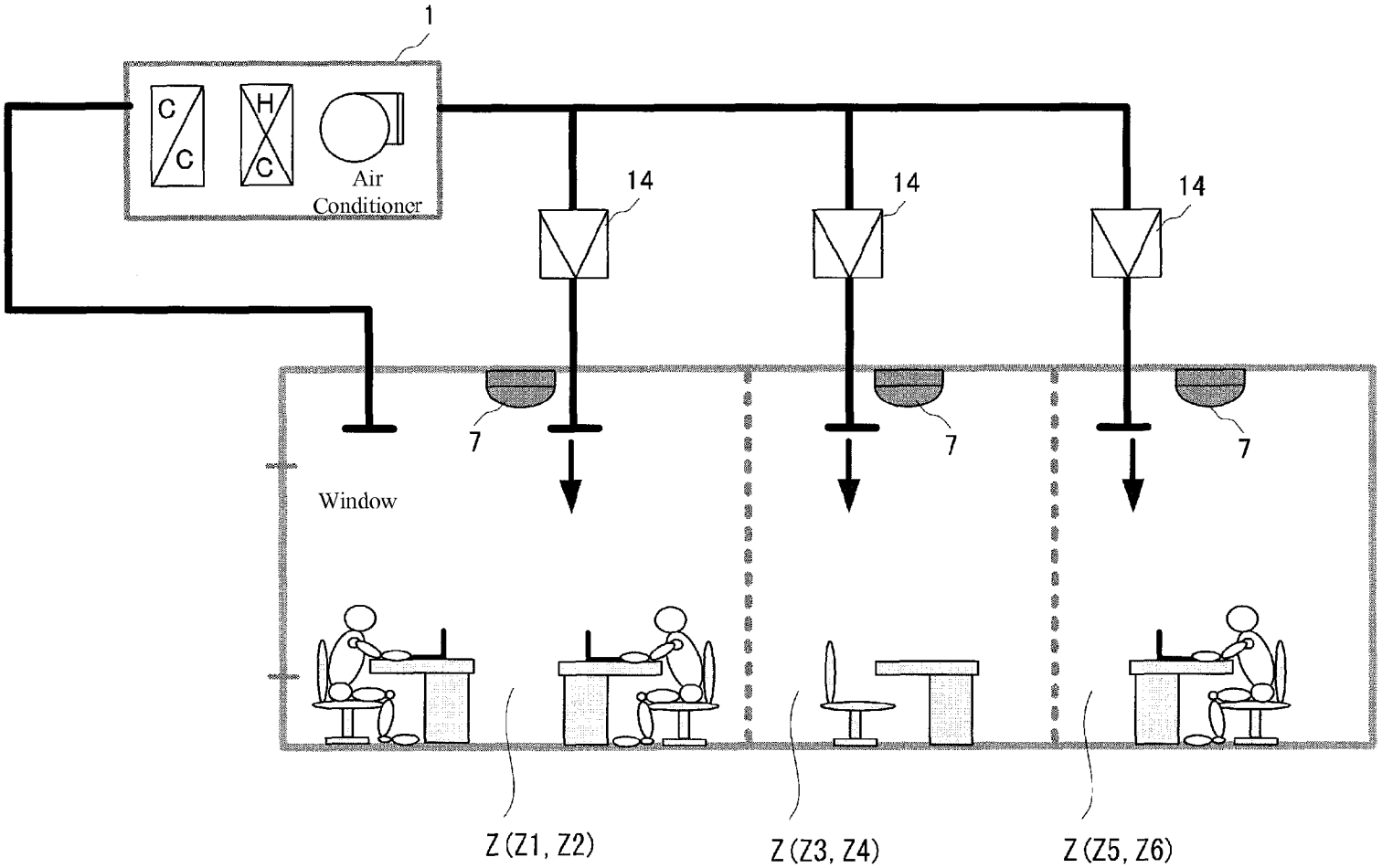
FIG. 14 is a diagram illustrating a VAV controlling system wherein a variable air volume regulating unit (VAV unit) is provided in each individual zone.

Moreover, while in the Another Example an example is shown wherein, as an air conditioning controlling system for performing air-conditioning by dividing a large space into a plurality of zones, air conditioners 1-1 and 1-2, and controlling devices 2-1 and 2-2, are provided for the zones Z1 and Z2, where the conditioned air from the air conditioner 1-1 is supplied to zone Z1 and the conditioned air from the air conditioner 1-2 is supplied to zone Z2, the heat quantity displaying device according to the present invention may instead be used in a VAV controlling system wherein a variable air volume adjusting unit (a VAV unit) 14 is provided in each zone Z, as illustrated in FIG. 14.

In such a VAV controlling system as well, for each zone Z the range of heat quantities that can be supplied from the air conditioner 1 to the zone Z, the heat quantity currently supplied from the air conditioner 1 to the zone Z, and the heat quantity currently required by the zone Z, are displayed simultaneously on the screen, together with the positional relationships between the zones Z, in the same manner as with the Another Example.

Figure 15:
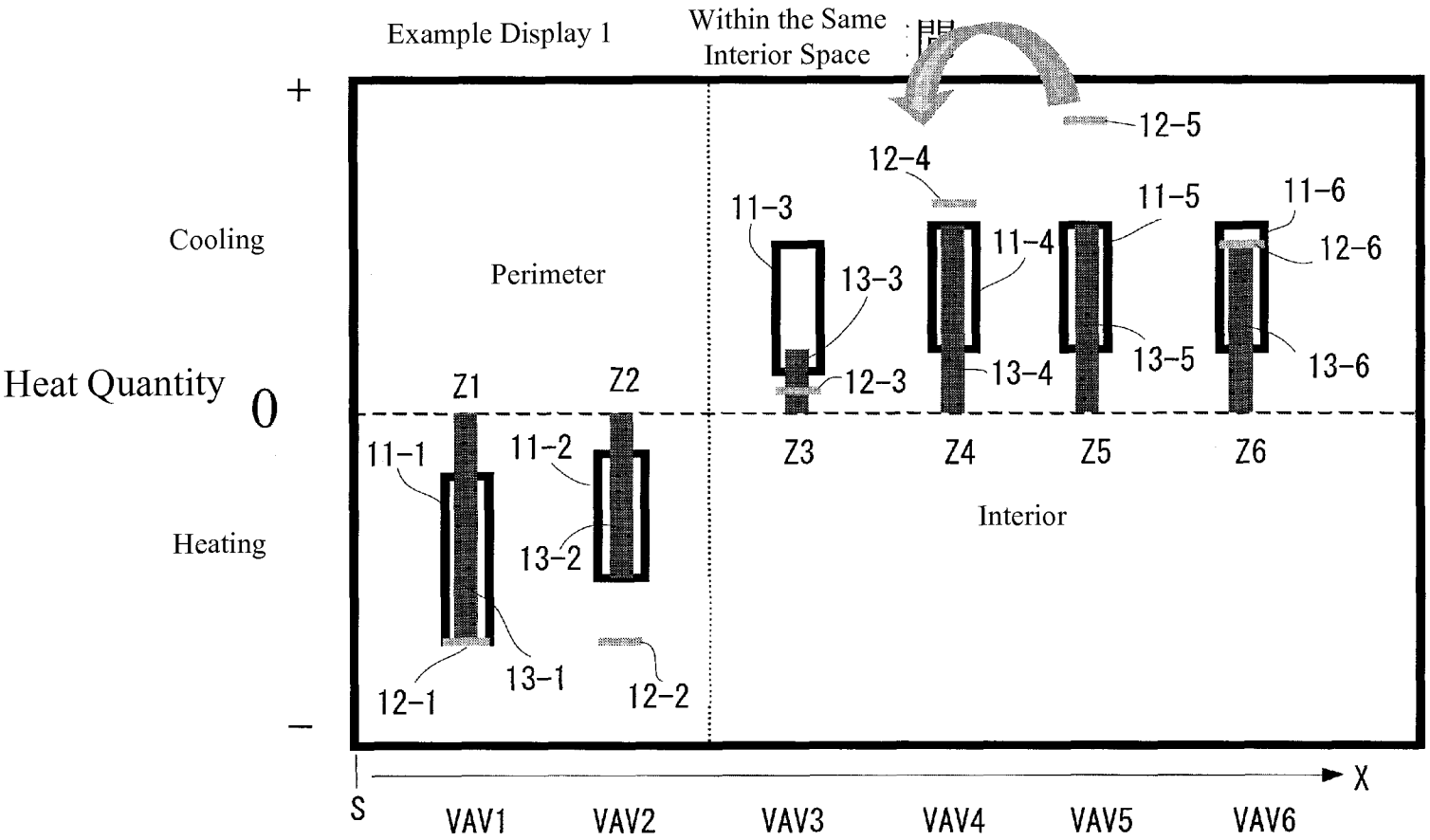
FIG. 15 is a diagram illustrating an example display of a VAV controlling system (corresponding to the first example display in the Another Example).

Exemplary Display of a VAV controlling system (corresponding to the Exemplary Display in the Another Example) is shown in FIG. 15. In zones Z2, Z3, Z4, and Z5, the "required heat quantities" are not within the range of "heat quantities that can be supplied," and thus it is necessary to consider countermeasures. In the case in the Exemplary Display, zone Z2 and Z5, wherein the differences between the required heat quantities" and the "heat quantities that can be supplied" are large, may contribute to zones Z3 and Z4, respectively. As a result, if improvements are made in zones Z2 and Z5, this may cause improvements in zones Z3 and Z4 as well. If there are heat sources, such as servers, in zone Z5, it may be possible to achieve an overall improvement by moving them to zone Z2.

Figure 16:
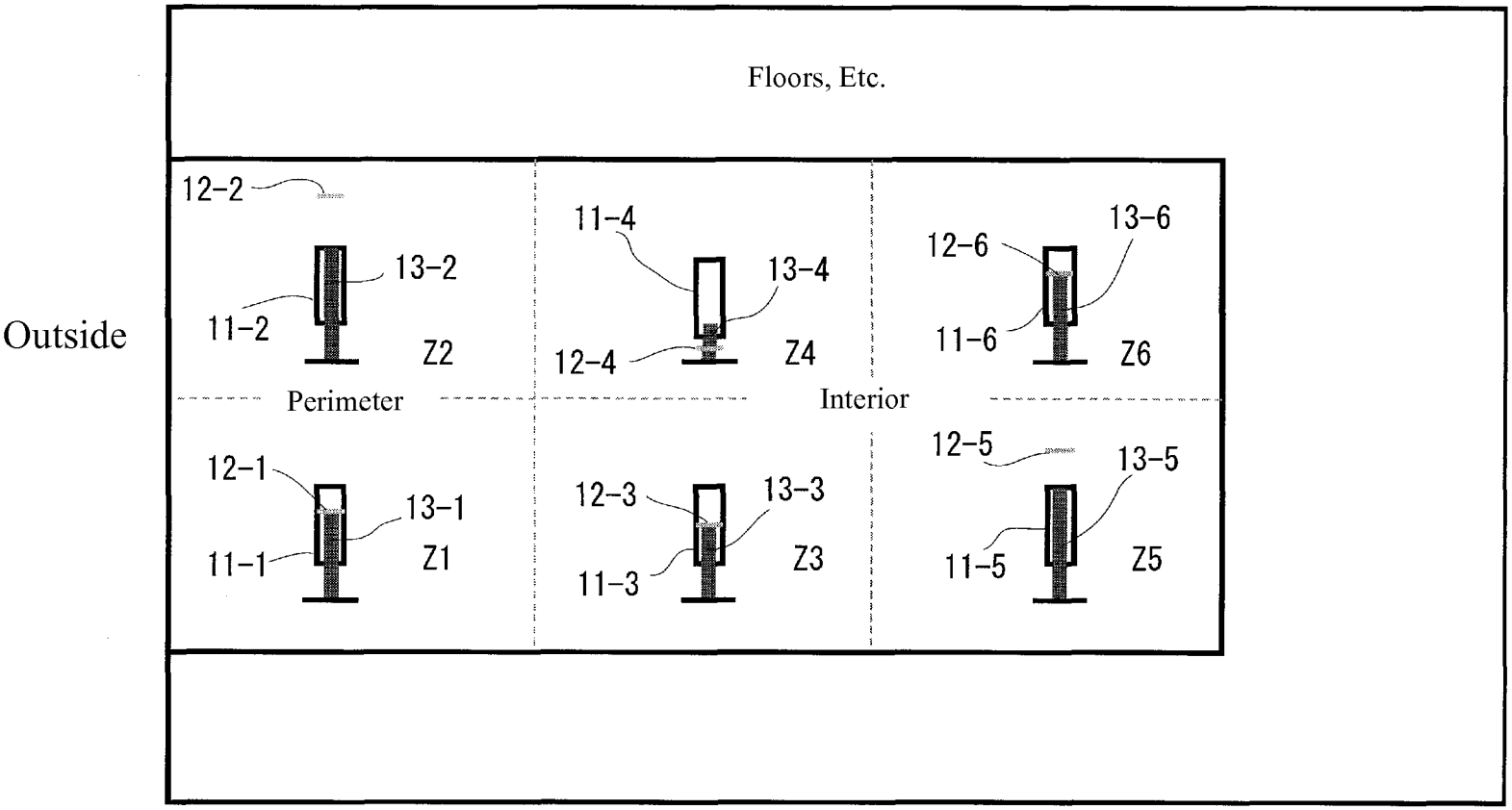
FIG. 16 is a diagram illustrating another example display of a VAV controlling system (corresponding to the third example display in the Another Example).

Another Exemplary Display of a VAV controlling system (corresponding to the Yet Another Exemplary Display in the Another Example) is shown in FIG. 16. The Another Exemplary Display shows, in a building floor plan, the state of supply of heat quantities in the zones Z1 through Z6. In this Another Exemplary Display, the vertical lines 13-1 and 13-2 that indicate the heat quantities currently supplied by the air conditioner 1-1 to zones Z1 and Z2 are, for example, shown in red in order to show that the heat quantities are required for heating. The vertical lines 13-3, 13-4, 13-5, and 13-6 that indicate the heat quantities currently supplied by the air conditioner 1-1 to zones Z3, Z4, Z5, and Z6 are, for example, shown in blue in order to show that the heat quantities are required for cooling.

Note that while in the examples set forth above the explanations were for examples wherein air conditioners were used for the air-conditioning equipment, the air-conditioning equipment is not limited to being air conditioners. Moreover, while, in the examples set forth above, such as shown in, for example, FIG. 15, for the plurality of zones Z the ranges of heat quantities that can be supplied from the air conditioner 1 to the zones Z, the heat quantities currently supplied from the air conditioner 1 to the zones Z, and the heat quantities currently required by the zones Z, were displayed simultaneously on the screen together with the positional relationships between the zones Z, the positional relationships between the zones Z need not necessarily be displayed. Even if the positional relationships are not displayed, if the plurality of zones Z are displayed similarly, the states of supply of heat quantities from the air conditioner 1 can be evaluated on a single screen.

Extended Examples

While the present disclosure has been explained above in reference to the examples, the present disclosure is not limited to the examples set forth above. The structures and details in the present disclosure may be varied in a variety of ways, as can be understood by one skilled in the art, within the scope of technology in the present disclosure.

The invention claimed is:

1. A heat quantity displaying device for displaying the state of supply of a heat quantity from air-conditioning equipment to a subject space that is subject to air-conditioning control, comprising:

a heat quantity display that displays substantially simultaneously on a screen at least a range of heat quantities that can be supplied by the air-conditioning equipment to the subject space, and a heat quantity currently required by the subject space, wherein:

the range of heat quantities that can be supplied is calculated according to the equation $Qs=C\cdot\rho\cdot W\cdot(Tr-Ts)$, wherein Qs is the range of heat quantities that can be supplied, C is the specific heat of air, ρ is the density of air, W is the flow rate of the air supplied from the air conditioner, Tr is the room temperature of the subject space, and Ts is the temperature of the air supplied from the air conditioner; and the heat quantity currently required by the subject space is calculated according to the equation $Qr=K\cdot A\cdot(Tm-Trs)$, wherein Qr is the heat quantity currently required by the subject space, K is the convective heat transfer coefficient of the entire surface of the subject space, A is the surface area of the entire surface of the subject space, Tm is the average temperature of the entire surface of the subject space, and Trs is the temperature set point.

2. The heat quantity displaying device as set forth in claim 1, wherein:

the heat quantity display displays, substantially simultaneously on a screen, the quantity of heat currently supplied by the air-conditioning equipment to the subject space, in addition to the range of heat quantities that can be supplied by the air-conditioning equipment to the subject space, and the heat quantity currently required by the subject space.

3. The heat quantity displaying device as set forth in claim 1, wherein:

the heat quantity display defines, as individual subject spaces, each of a plurality of zones into which a large space is divided.

4. The heat quantity displaying device as set forth in claim 3, wherein:

the heat quantity display displays a heat quantity, for each individual zone, together with at least one positional relationship of the zones.

5. The heat quantity displaying device as set forth in claim 1, wherein:

the heat quantity display displays separately a heat quantity required for heating and a heat quantity required for cooling.

6. A heat quantity displaying method for displaying the state of supply of a heat quantity from air-conditioning equipment to a subject space that is subject to air-conditioning control, comprising:

displaying, substantially simultaneously, on a screen at least a range of heat quantities that can be supplied by the air-conditioning equipment to the subject space, and a heat quantity currently required by the subject space, wherein:

the range of heat quantities that can be supplied is calculated according to the equation $Qs=C\cdot\rho\cdot W\cdot(Tr-Ts)$, wherein Qs is the range of heat quantities that can be supplied, C is the specific heat of air, ρ is the density of air, W is the flow rate of the air supplied from the air conditioner, Tr is the room temperature of the subject space, and Ts is the temperature of the air supplied from the air conditioner; and the heat quantity currently required by the subject space is calculated according to the equation $Qr=K\cdot A\cdot(Tm-Trs)$, wherein Qr is the heat quantity currently required by the subject space, K is the convective heat transfer coefficient of the entire surface of the subject space, A is the surface area of the entire surface of the subject space, Tm is the average temperature of the entire surface of the subject space, and Trs is the temperature set point.

7. The heat quantity displaying method as set forth in claim 6, wherein:

the heat quantity displaying step displays, substantially simultaneously on a screen, the quantity of heat currently supplied by the air-conditioning equipment to the subject space, in addition to the range of heat quantities that can be supplied by the air-conditioning equipment to the subject space, and the heat quantity currently required by the subject space.

8. The heat quantity displaying method as set forth in claim 6, wherein:

the heat quantity displaying step defines, as individual subject spaces, each of a plurality of zones into which a large space is divided.

9. The heat quantity displaying method as set forth in claim 8, wherein:

the heat quantity displaying step displays a heat quantity, for each individual zone, together with at least one positional relationship of the zones.

10. The heat quantity displaying method as set forth in claim 6, wherein:

the heat quantity displaying step displays separately a heat quantity required for heating and a heat quantity required for cooling.

* * * * *